US010676882B2

(12) United States Patent
Dickson

(10) Patent No.: US 10,676,882 B2
(45) Date of Patent: Jun. 9, 2020

(54) CAM OPERATED GRINDING MACHINE

(71) Applicant: Dickson Industries, Inc., Tecumseh, OK (US)

(72) Inventor: Wayne E. Dickson, Tecumseh, OK (US)

(73) Assignee: Dickson Industries, Inc., Tecumseh, OK (US)

( * ) Notice: Subject to any disclaimer, the term of this patent is extended or adjusted under 35 U.S.C. 154(b) by 0 days.

(21) Appl. No.: 16/007,359

(22) Filed: Jun. 13, 2018

(65) Prior Publication Data

US 2018/0355563 A1 Dec. 13, 2018

Related U.S. Application Data

(60) Provisional application No. 62/518,996, filed on Jun. 13, 2017.

(51) Int. Cl.

| | |
|---|---|
| ***E01C 23/00*** | (2006.01) |
| ***E01C 23/09*** | (2006.01) |
| ***E01C 23/088*** | (2006.01) |
| ***B24B 19/02*** | (2006.01) |
| *E01C 23/02* | (2006.01) |
| *B24B 7/18* | (2006.01) |

(52) U.S. Cl.

CPC ..... *E01C 23/0993* (2013.01); *B24B 19/02* (2013.01); *E01C 23/088* (2013.01); *B24B 7/186* (2013.01); *E01C 23/025* (2013.01); *E01C 23/0933* (2013.01)

(58) Field of Classification Search

CPC ..... E01C 23/0993; E01C 23/088; E01C 23/0933; E01C 23/025; B24B 19/02; B24B 19/7186; B24B 7/186

USPC ..... 404/75, 93, 94

See application file for complete search history.

(56) References Cited

U.S. PATENT DOCUMENTS

| | | | | |
|---|---|---|---|---|
| 4,646,481 | A | 3/1987 | Dickson | |
| 4,693,041 | A | 9/1987 | Dickson | |
| 4,753,052 | A | 6/1988 | Dickson | |
| 4,788,799 | A | 12/1988 | Dickson | |
| 4,841,681 | A | 6/1989 | Dickson | |
| 5,046,890 | A | 9/1991 | Dickson | |
| 5,129,755 | A | 7/1992 | Dickson | |
| 5,215,071 | A * | 6/1993 | Mertes | B27B 9/02 125/13.01 |
| 5,236,278 | A | 8/1993 | Dickson | |
| 5,378,080 | A | 1/1995 | Dickson | |
| 5,391,017 | A | 2/1995 | Thomas et al. | |
| 5,456,547 | A | 10/1995 | Thomas et al. | |
| 5,484,228 | A | 1/1996 | Thomas et al. | |

(Continued)

*Primary Examiner* — Raymond W Addie

(74) *Attorney, Agent, or Firm* — McAfee & Taft

(57) ABSTRACT

An apparatus for cutting grooves in a ground surface includes a wheeled vehicle with a tool carrier connected to the wheeled vehicle. The tool carrier is rotatable about an axis parallel to the direction of travel of the vehicle and perpendicular to the direction of travel of the vehicle. A grinding tool for cutting grooves in a ground surface is rotatably mounted to the tool carrier. The grinding tool may be movable laterally relative to the vehicle. A rotatable cam is configured so that rotation of the cam causes pivotal movement of the tool carrier relative to the forward frame. Rotation of the cam moves the grinding tool into and out of engagement with the ground surface.

25 Claims, 23 Drawing Sheets

(56) References Cited

U.S. PATENT DOCUMENTS

| | | | | |
|---|---|---|---|---|
| 5,503,499 | A | 4/1996 | Thomas et al. | |
| 5,607,255 | A | 3/1997 | Thomas et al. | |
| 5,695,299 | A | 12/1997 | Thomas et al. | |
| 5,860,764 | A * | 1/1999 | Roberts | E01C 19/236 404/124 |
| 5,957,620 | A | 9/1999 | Thomas et al. | |
| 6,402,252 | B1 | 6/2002 | Dickson | |
| 6,454,490 | B1 * | 9/2002 | Murphy | E01C 23/0993 404/75 |
| 6,755,482 | B2 | 6/2004 | Johnson | |
| 8,821,063 | B2 | 9/2014 | Johnson et al. | |
| 9,272,383 | B1 | 3/2016 | Dickson | |
| 9,574,310 | B2 * | 2/2017 | Johnson | E01C 19/004 |
| 9,919,400 | B2 | 3/2018 | Dickson | |
| 2004/0166774 | A1 * | 8/2004 | Cochran | E01C 23/088 451/11 |

* cited by examiner

CAM OPERATED GRINDING MACHINE

CROSS-REFERENCE TO RELATED APPLICATION

This application claims the benefit of U.S. Provisional Application No. 62/518,996 filed Jun. 13, 2017, which is incorporated herein by reference.

BACKGROUND

This disclosure is directed to an apparatus for creating spaced impressions or grooves in the roadway surface and/or on the shoulders along roadways. The impressions, or grooves are generally used as a warning for drivers that they have moved off the main roadway, or across a lane or dividing line. When the tires of the vehicle contact the grooves, a noise is heard and vibration is felt which alerts the driver that the tires are in contact with the groves and that the driver is moving off the roadway or out of the proper lane. Such impressions, or grooves are frequently referred to as rumble strips. There are a number of apparatus and methods used for moving a grinding tool in and of the the surface to create the grooves, and to do so with proper spacing. The embodiment disclosed herein is directed to an apparatus that is easy to operate, and easy to move between grinding and travelling positions. The apparatus disclosed provides for easy, accurate spacing, and for a method of cutting groups of grooves with a space between the groups.

SUMMARY

The current disclosure is directed to an apparatus for cutting grooves in a ground surface. The apparatus may include a wheeled vehicle with a tool carrier connected to the wheeled vehicle. The tool carrier in some embodiments is rotatable about an axis parallel to the direction of travel of the vehicle and perpendicular to the direction of travel of the vehicle. In one embodiment a grinding tool is rotatably mounted to the tool carrier. The grinding tool may be movable laterally relative to the vehicle. A forward frame is pivotally connected to the tool carrier. A wheel positioned in front of the grinding tool is rotatable about a wheel axle supported by the forward frame. A rotatable cam is configured so that rotation of the cam causes pivotal movement of the tool carrier relative to the forward frame.

In one embodiment, a cam roller is connected to the tool carrier and configured to engage the cam. Rotation of the cam moves the grinding wheel up and down relative to the ground surface. The cam may rotate with the wheel axle. The cam roller is connected to the tool carrier so that the rotation of the cam simultaneously raises and lifts the cam roller and tool carrier.

The apparatus can comprise an actuator configured to move the grinding tool between a skip and a grinding position. In the skip position the grinding tool is spaced upwardly a sufficient distance from the ground surface such that continued up and down movement of the grinding tool will not bring the grinding tool into engagement with the ground surface. In the grinding position the grinding tool moves into and out of engagement with the ground surface to cut grooves therein. The actuator can comprise a first hydraulic cylinder connected to the tool carrier, such that extension and retraction of a piston rod extending from the hydraulic cylinder raises and lowers the grinding tool between the skip and grinding positions relative to a ground surface. In one embodiment the grinding tool is in the skip position when the piston rod is in a fully extended position. The apparatus includes a control system that enables the grinding tool to automatically move between the grinding and skip positions.

The grinding tool may be movable laterally relative to the wheeled vehicle. The tool carrier is pivotally connected to the wheeled vehicle In one embodiment a timing wheel is operably associated with the cam. The apparatus may include a Programmable Logic Controller ("PLC"). A sensor operably associated with the timing wheel sends a signal to the PLC reflecting a specified distance of travel of the apparatus based on the rotation of the timing wheel. In some embodiments a full rotation of the timing wheel corresponds to a full rotation of the cam, and wherein. The PLC may send a signal to the skip control cylinder at specified distances to automatically move the grinding tool between the grinding and the skip positions.

BRIEF DESCRIPTION OF THE DRAWINGS

FIG. 6 is an additional view looking down at the top of the apparatus without the connection to the vehicle and without the tool bar frame.

FIG. 9 is an isometric showing details of the forward frame.

FIG. 12 is a view looking up at the underside of the apparatus without the tool bar connecting frame.

FIG. 16 is another isometric of the grinding tool showing the left and rear sides.

FIG. 19 is a view of the tool bar frame.

FIG. 26 shows the apparatus in the grinding position with the grinding tool disengaged from the ground surface.

DETAILED DESCRIPTION OF THE EMBODIMENT

Figure 1:
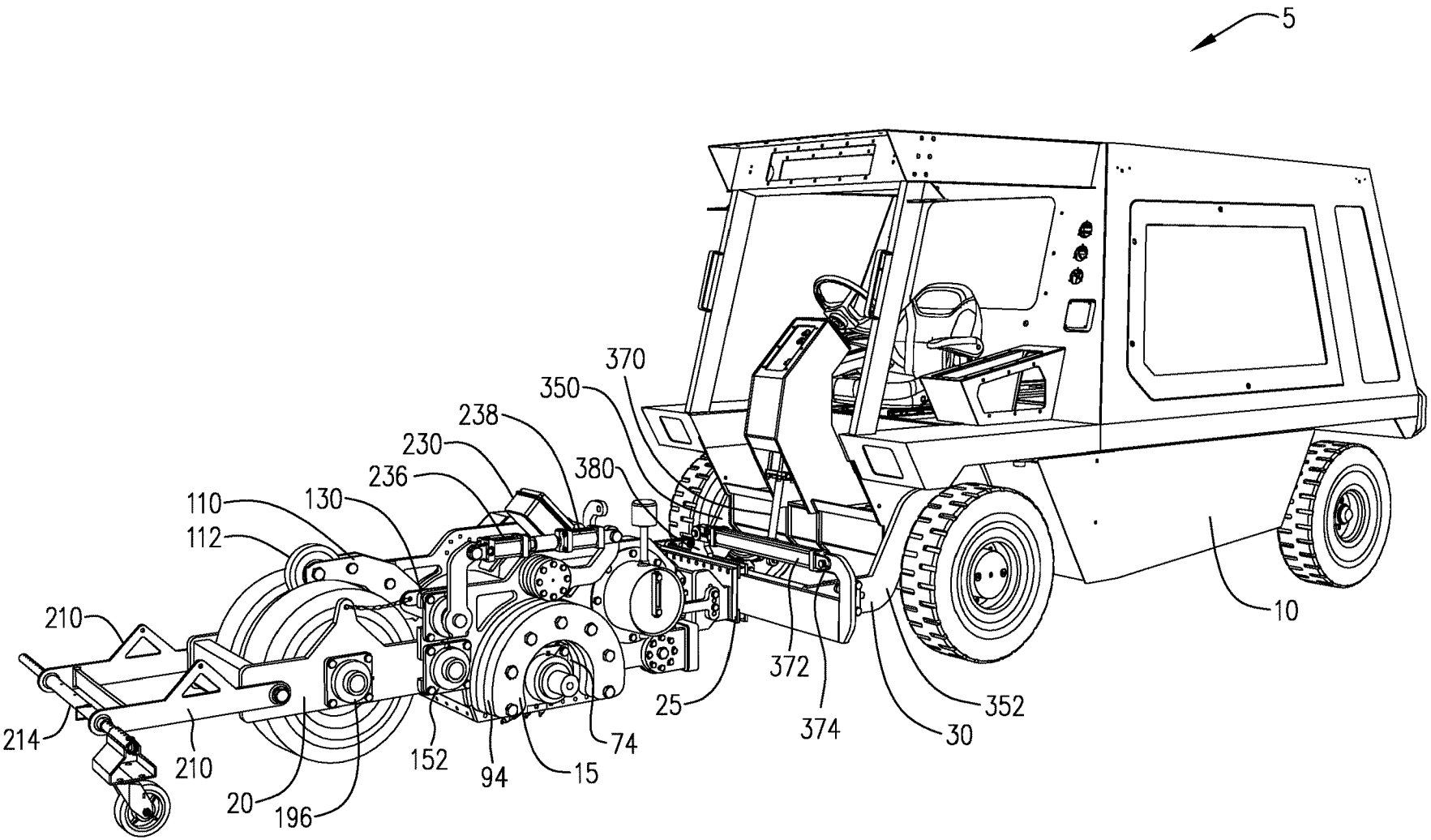
FIG. 1 is an isometric of the apparatus of the current invention.
Figure 2:
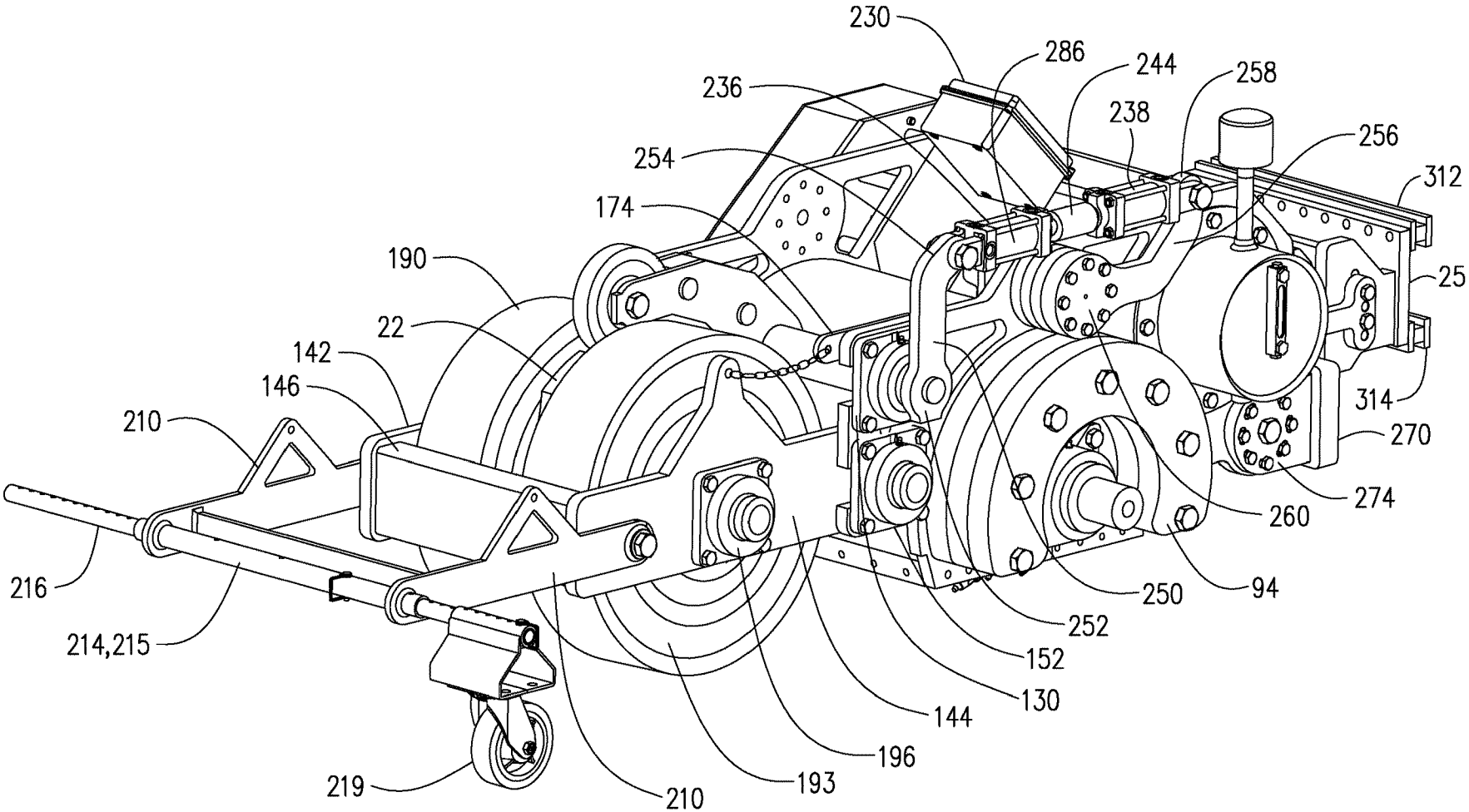
FIG. 2 is an isometric showing the left side of the apparatus without the connection to the vehicle.
Figure 3:
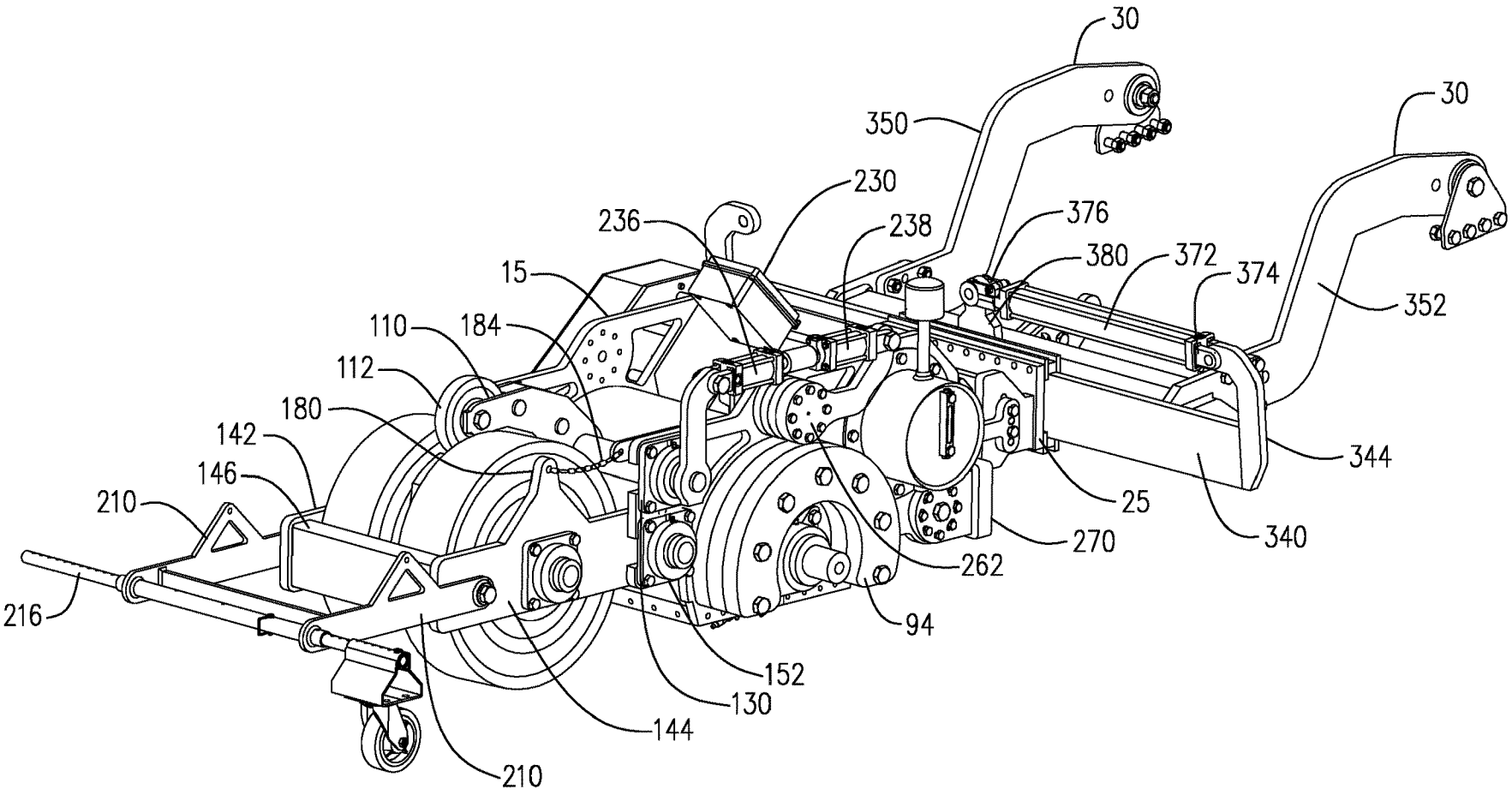
FIG. 3 is an isometric looking at the left side showing the tool carrier and tool bar connecting frame.
Figure 4:
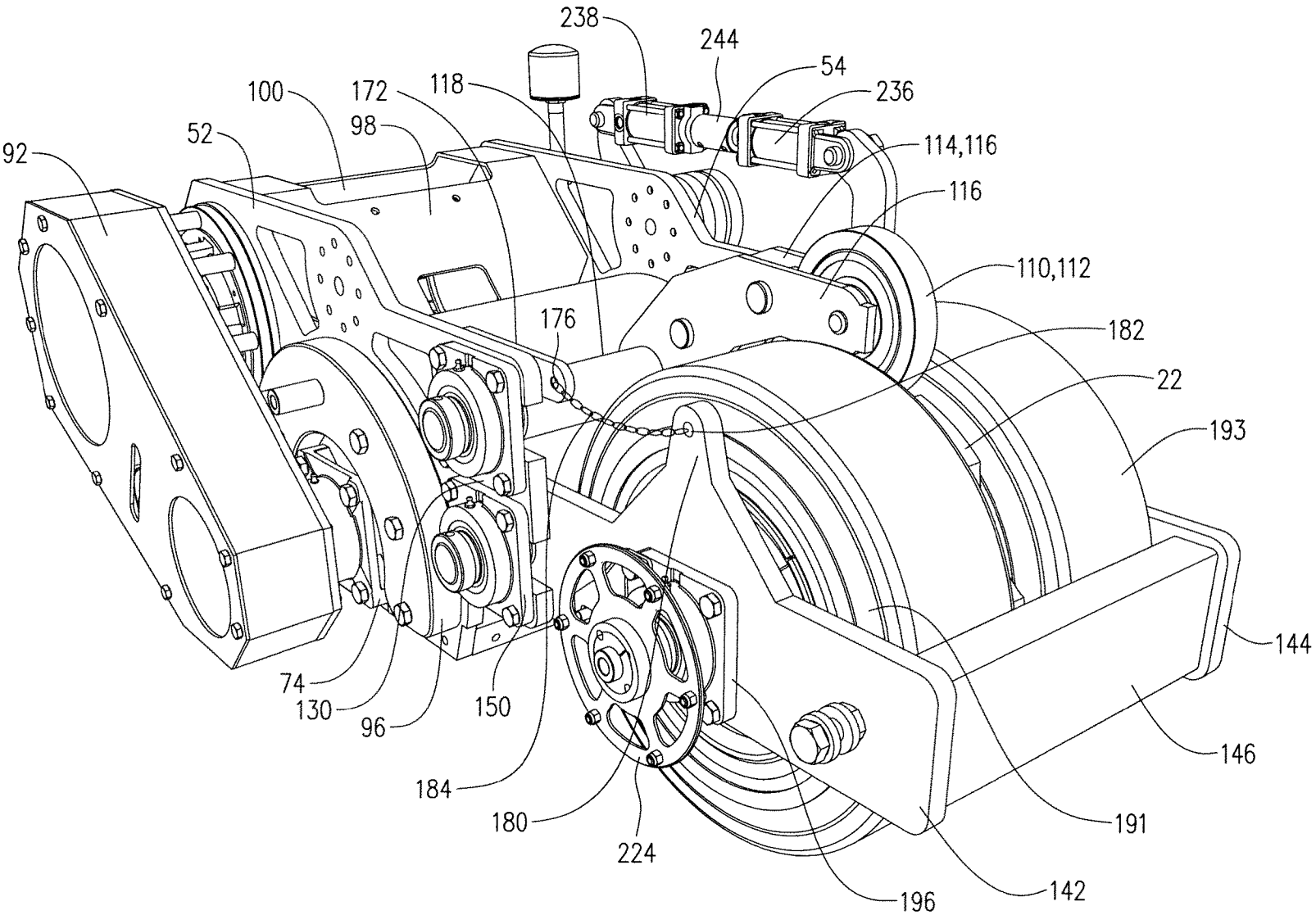
FIG. 4 is an isometric looking at the right side of the tool carrier and wheel carrier.
Figure 5:
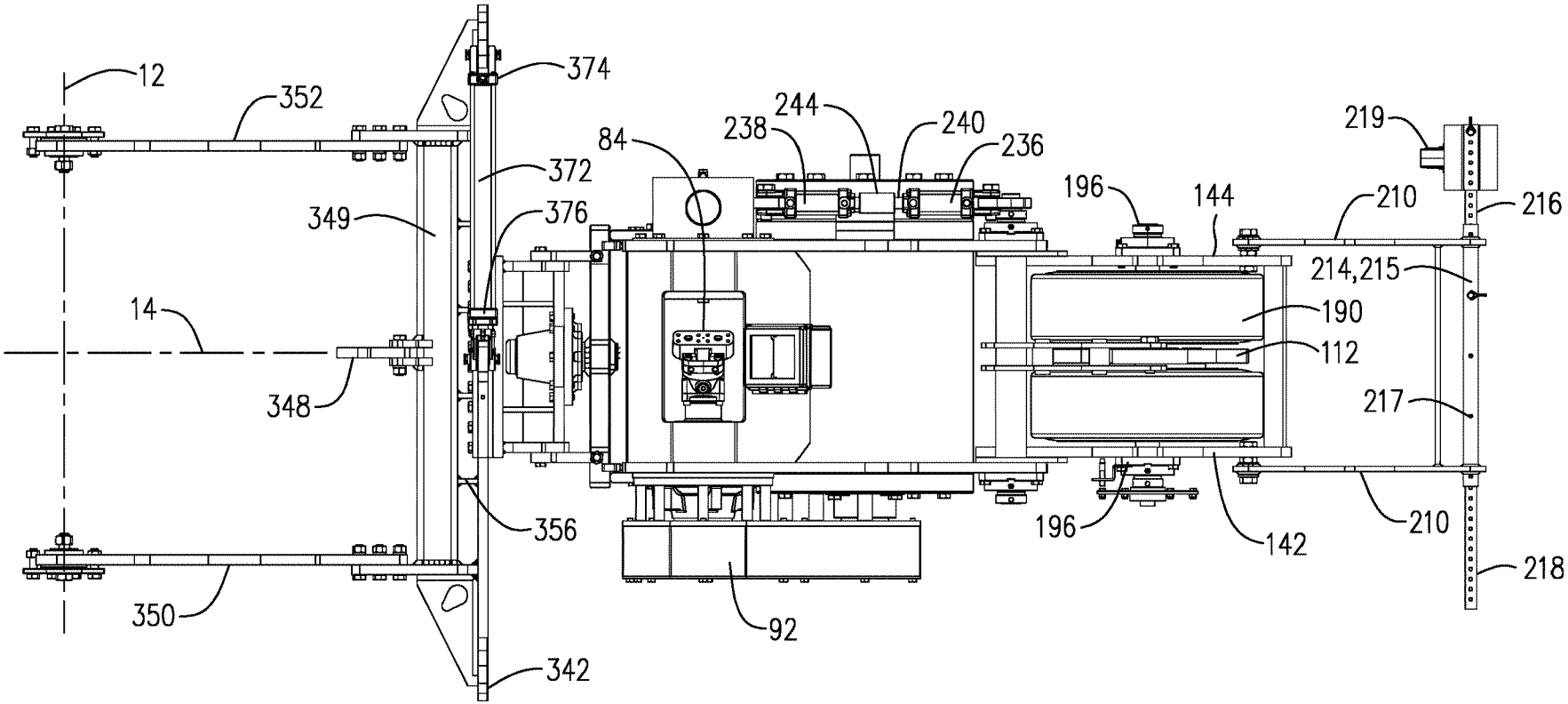
FIG. 5 is a view looking down at the top of the apparatus without the vehicle.
Figure 3:
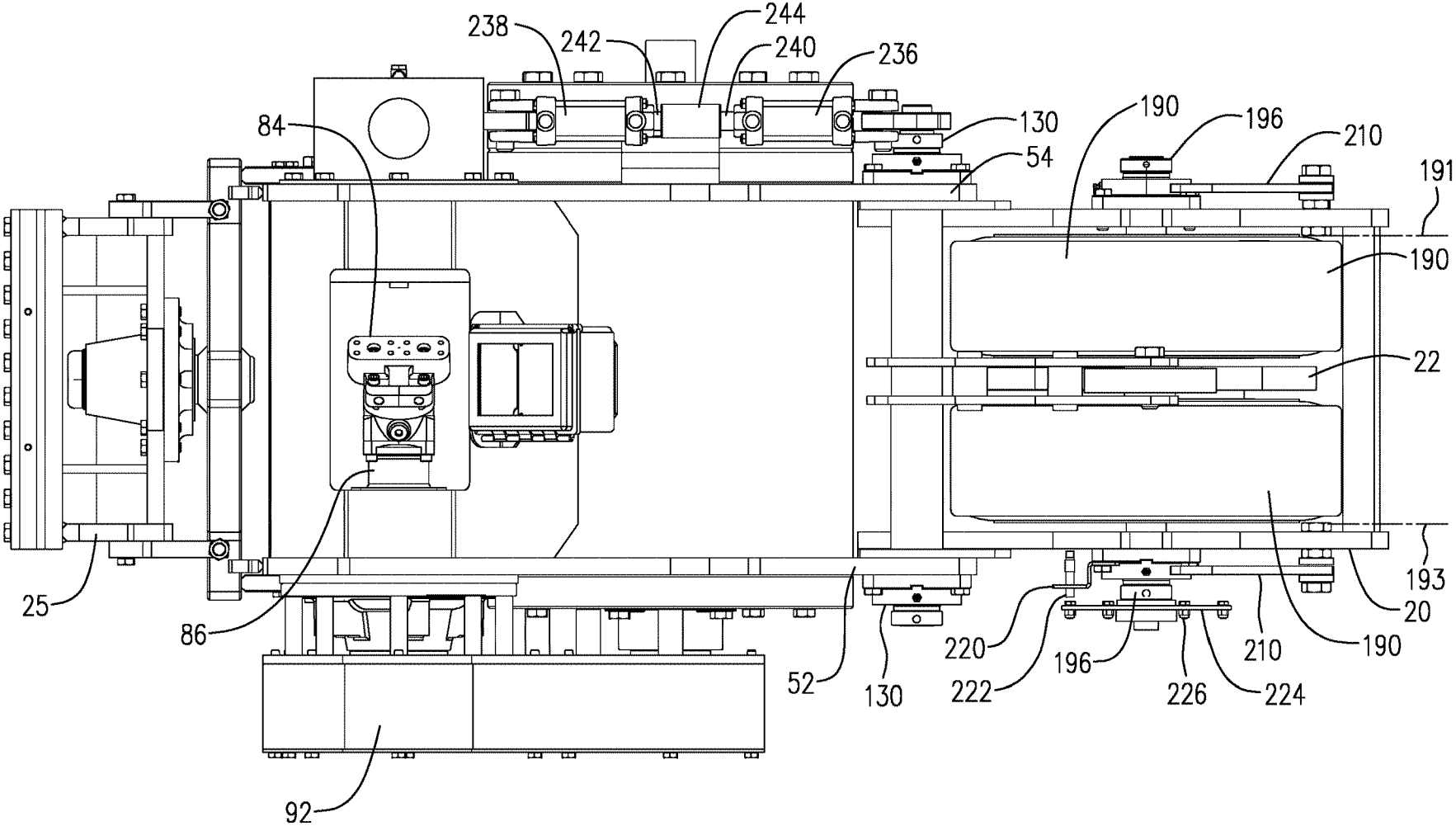
Figure 7:
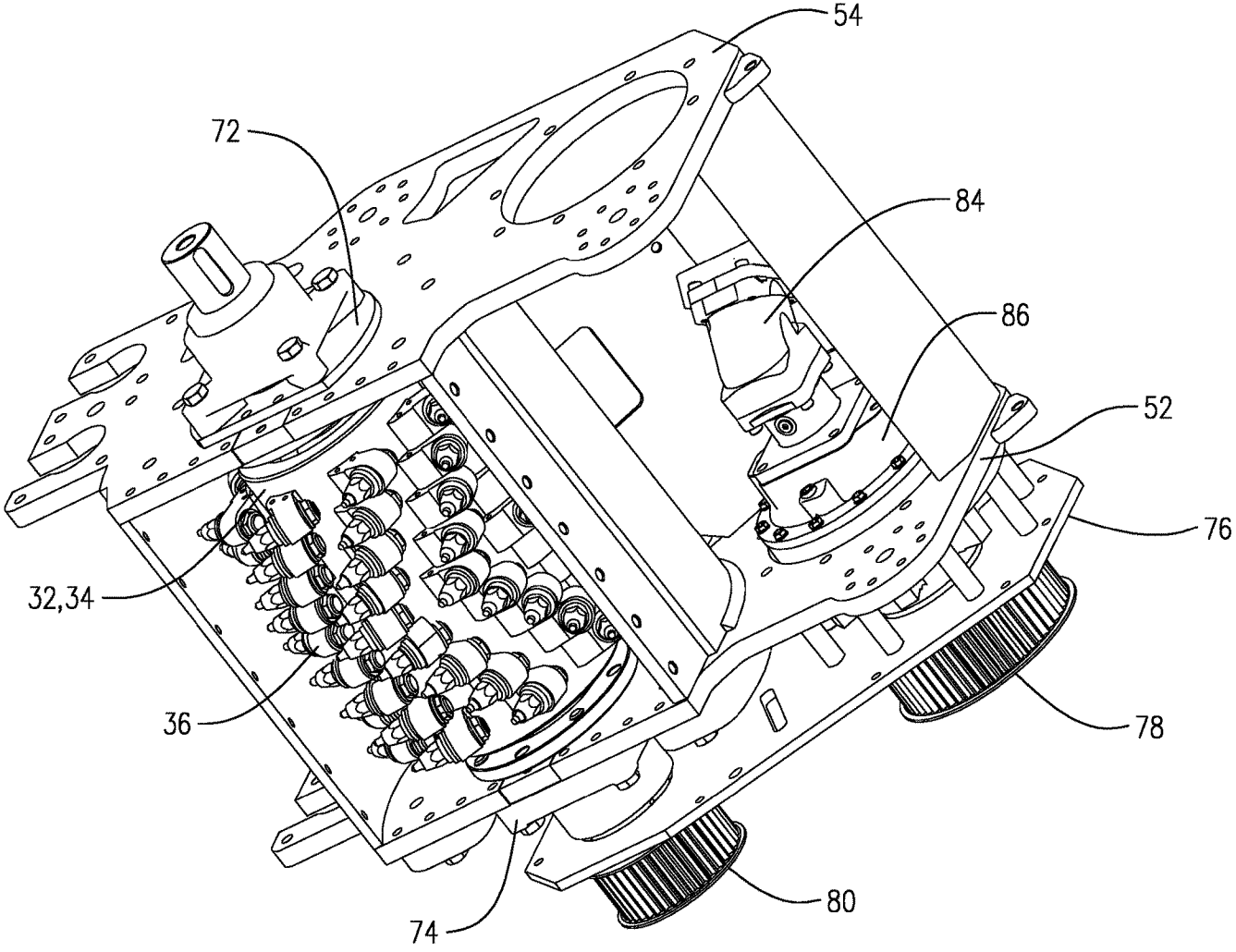
FIG. 7 is an isometric looking at the underside of the tool carrier.
Figure 8:
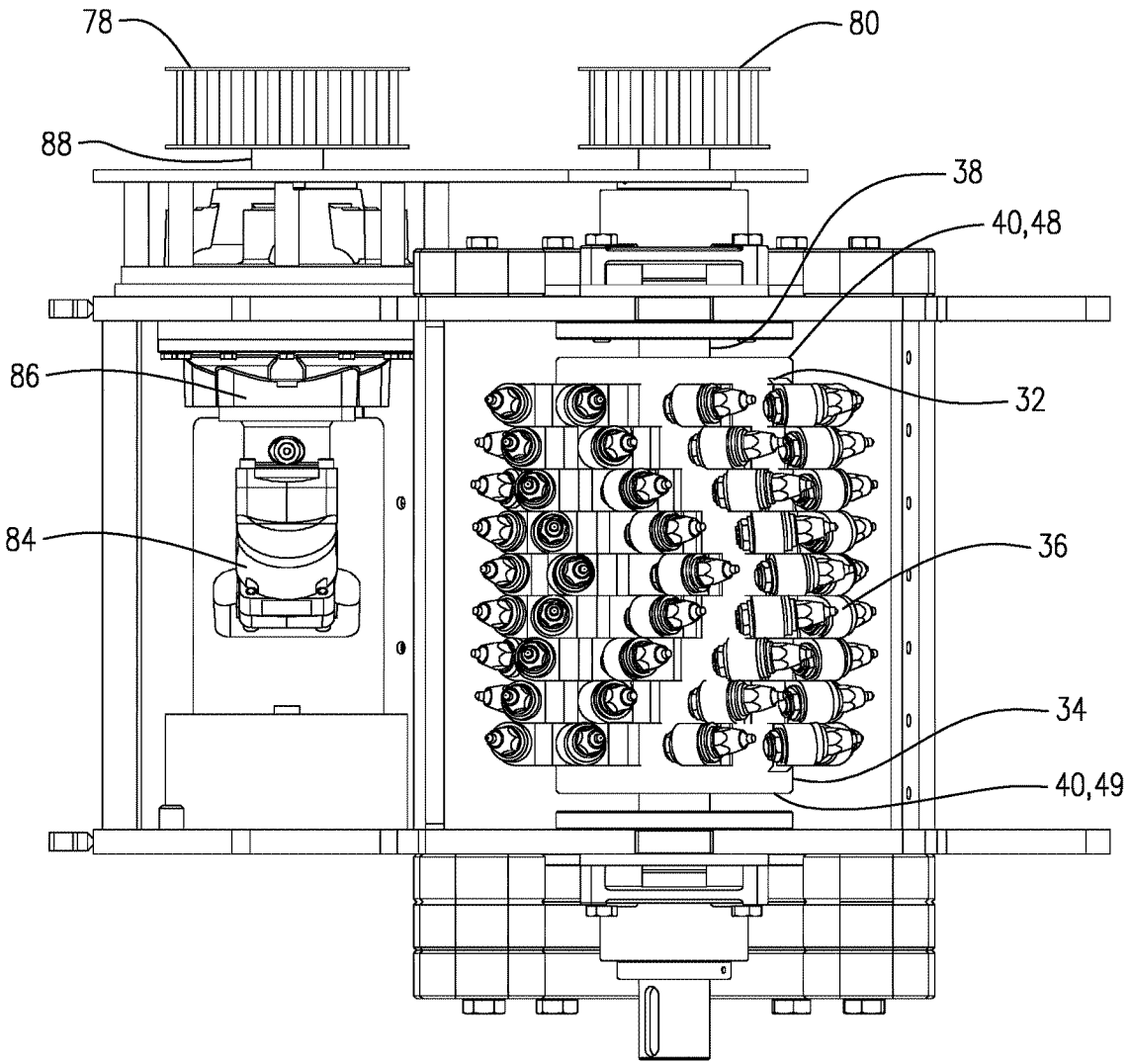
FIG. 8 is an elevation view looking at the underside of the tool carrier.
Figure 5:
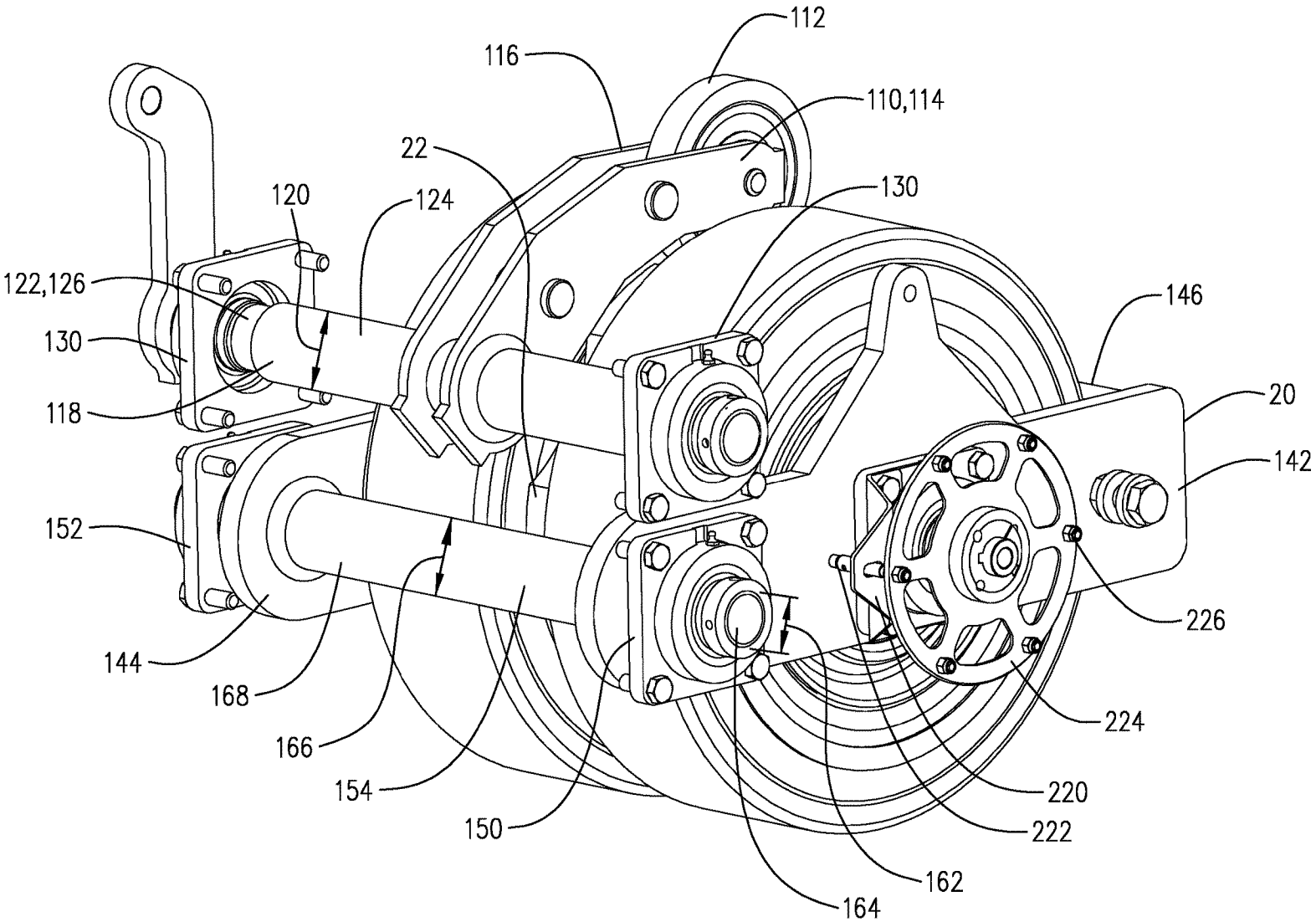

Referring now to the drawings, an apparatus 5 for cutting grooves (FIG. 1) in a ground surface 6 (FIG. 22) is shown and described. It will be recognized that not all details are shown in every FIGURE for the sake of clarity and description. In one embodiment apparatus 5 is configured to cut grooves in a shoulder adjacent to a roadway, and/or in a roadway surface. Apparatus 5 includes a vehicle 10 which is a powered vehicle, a tool carrier 15 connected thereto and a wheel mounting assembly 20 connected to the tool carrier 15. A rotatable cam 22 is located toward a front end of apparatus 5. Wheel mounting assembly 20 comprises a forward frame positioned forward of the tool carrier 15 Thus wheel mounting assembly 20 may be referred to as wheel mounting assembly 20 or forward frame 20. A tool carrier connecting frame 25 is connected to a tool bar frame 30 to connect tool carrier 15 to vehicle 10. Tool carrier 15 carries a rotatable grinding tool 32 shown, for example, in FIG. 7 and FIG. 8. Grinding tool 32 comprises a grinding drum 34 with a plurality of bits 36 connected thereto. Grinding tool 32 likewise includes a tool shaft 38 and plates 40. Plates 40 are connected to drum 34 at both ends thereof by welding. Shaft 38 is likewise fixed to plates 40 so that rotation of shaft 32 will rotate drum 34 along with grinding bits 36. Shaft 38, and thus grinding tool 32 is rotatably mounted to tool carrier 15. Bits 36 may be connected to drum 34 in a manner known in the art. In the embodiment described bit holders 42 are connected to drum 34. Bit holders 42 have bit sleeves 44 received in openings 46 therein. Such a configuration provides for easy and efficient removal and replacement of worn and/or damaged bits. In addition, the bits can be easily removed and replaced if a different bit material is desired. Grinding drum 34 may have outer edges 48 and 49.

Tool carrier 15 is pivotable relative to vehicle 10 about an axis 12 perpendicular to the direction of travel of the vehicle 15, and is also pivotable about an axis 14 that is parallel to the direction of travel of the vehicle. As will be explained in more detail, tool carrier 15 is also movable laterally relative to vehicle 10. Because of the pivotability relative to vehicle 10, tool carrier 15 and thus grinding tool 32 is allowed to float or follow the contour of the ground. Grinding tool 32 is rotatably mounted to tool carrier 15 and when in operation will cut grooves into a ground surface which may be, for example, a roadway surface or a shoulder adjacent a roadway. The operation of apparatus 5 and grinding tool 32 will be explained in more detail hereinbelow.

Figure 10:
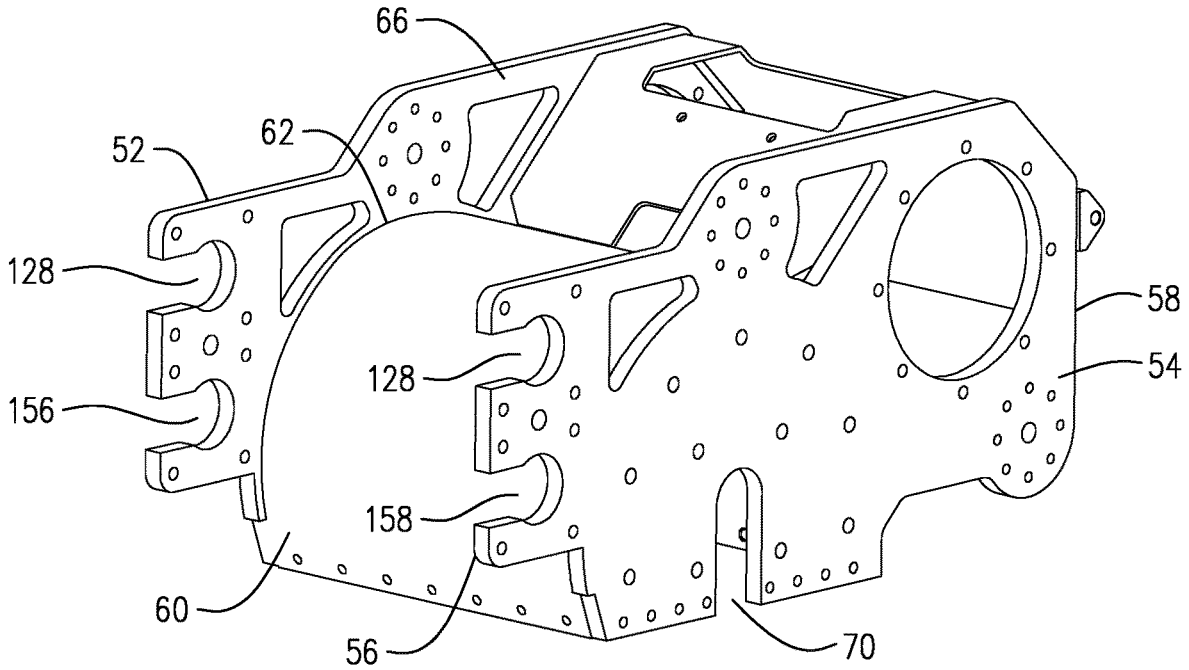
FIG. 10 is an isometric showing the left side of the tool carrier frame.
Figure 11:
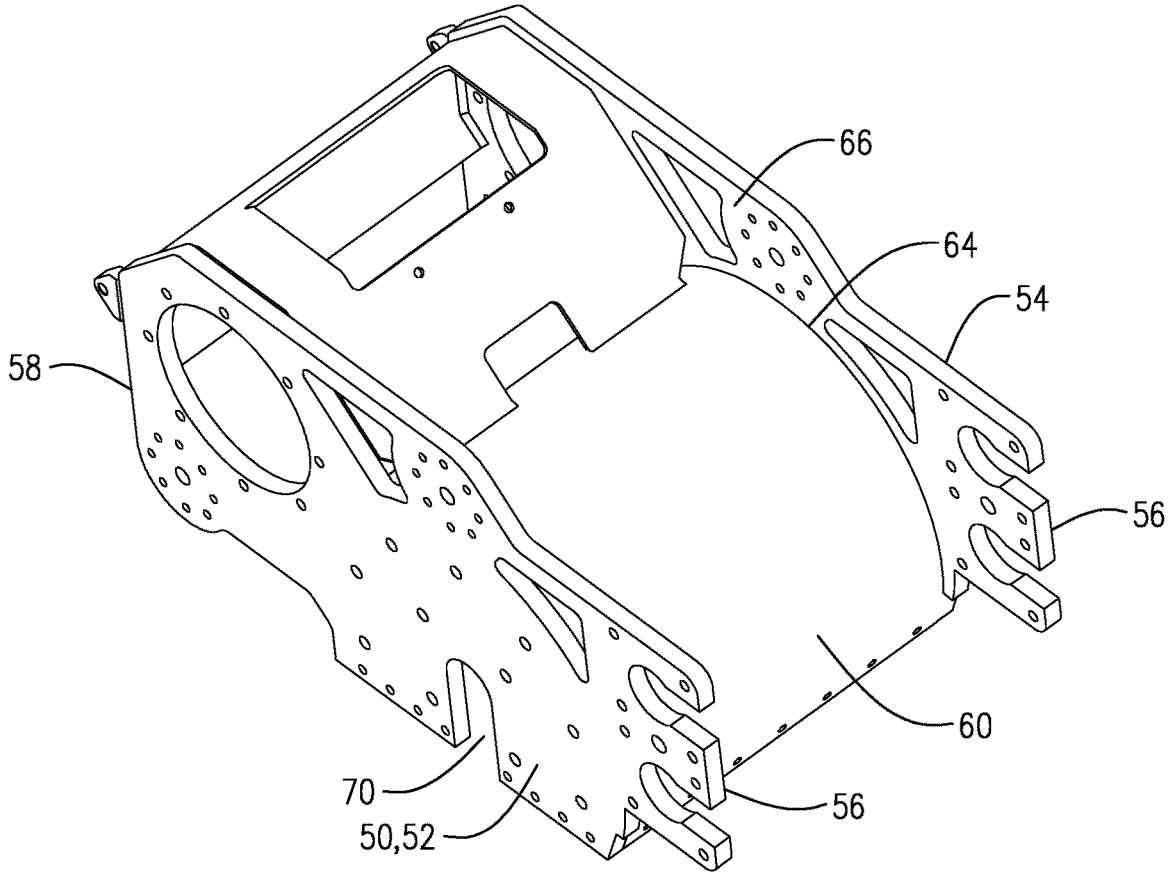
FIG. 11 is an additional view of the tool carrier frame.
Figure 17:
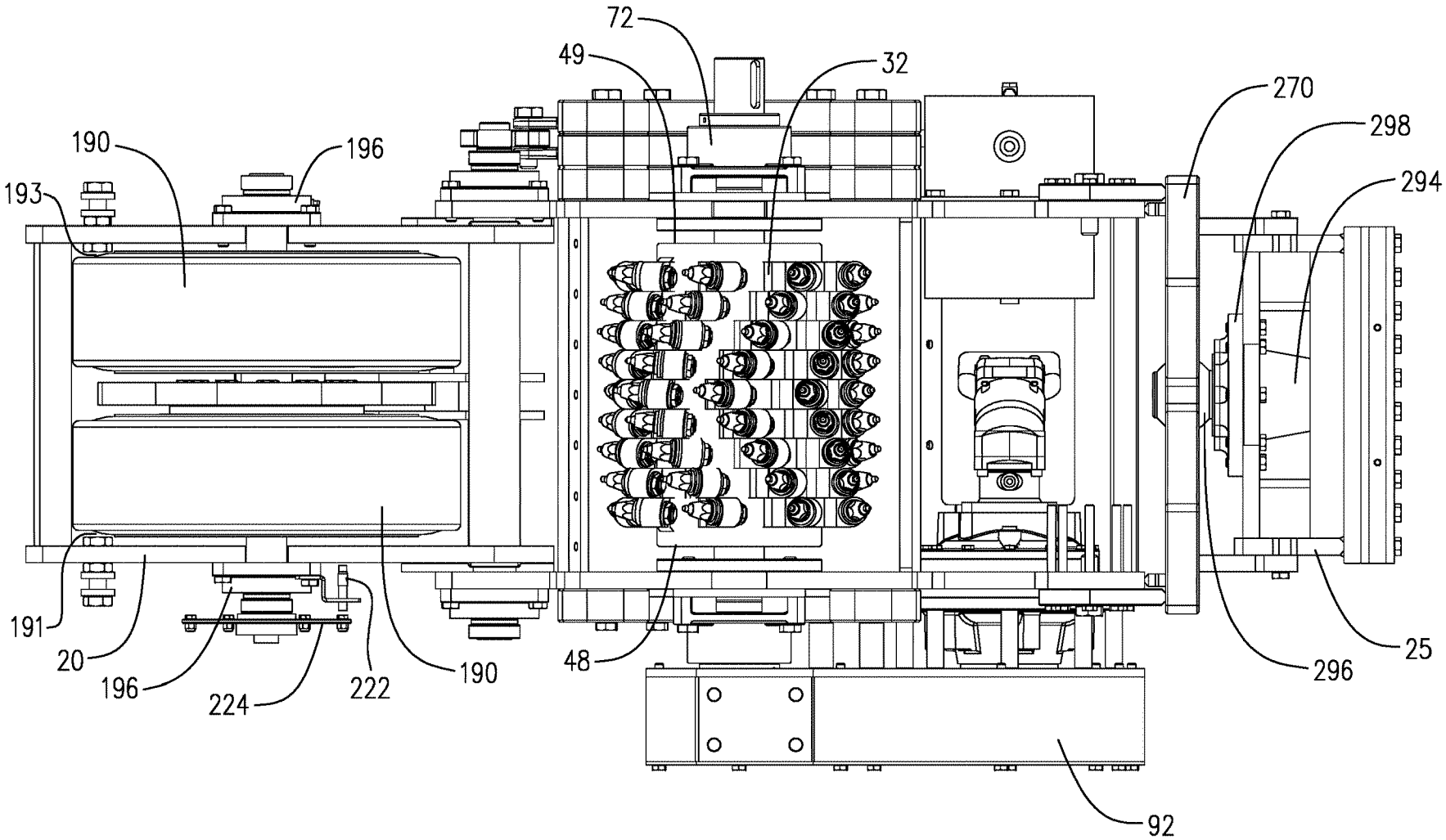
FIG. 17 is a view showing the pulley system utilized to drive the grinding tool.
Figure 13:
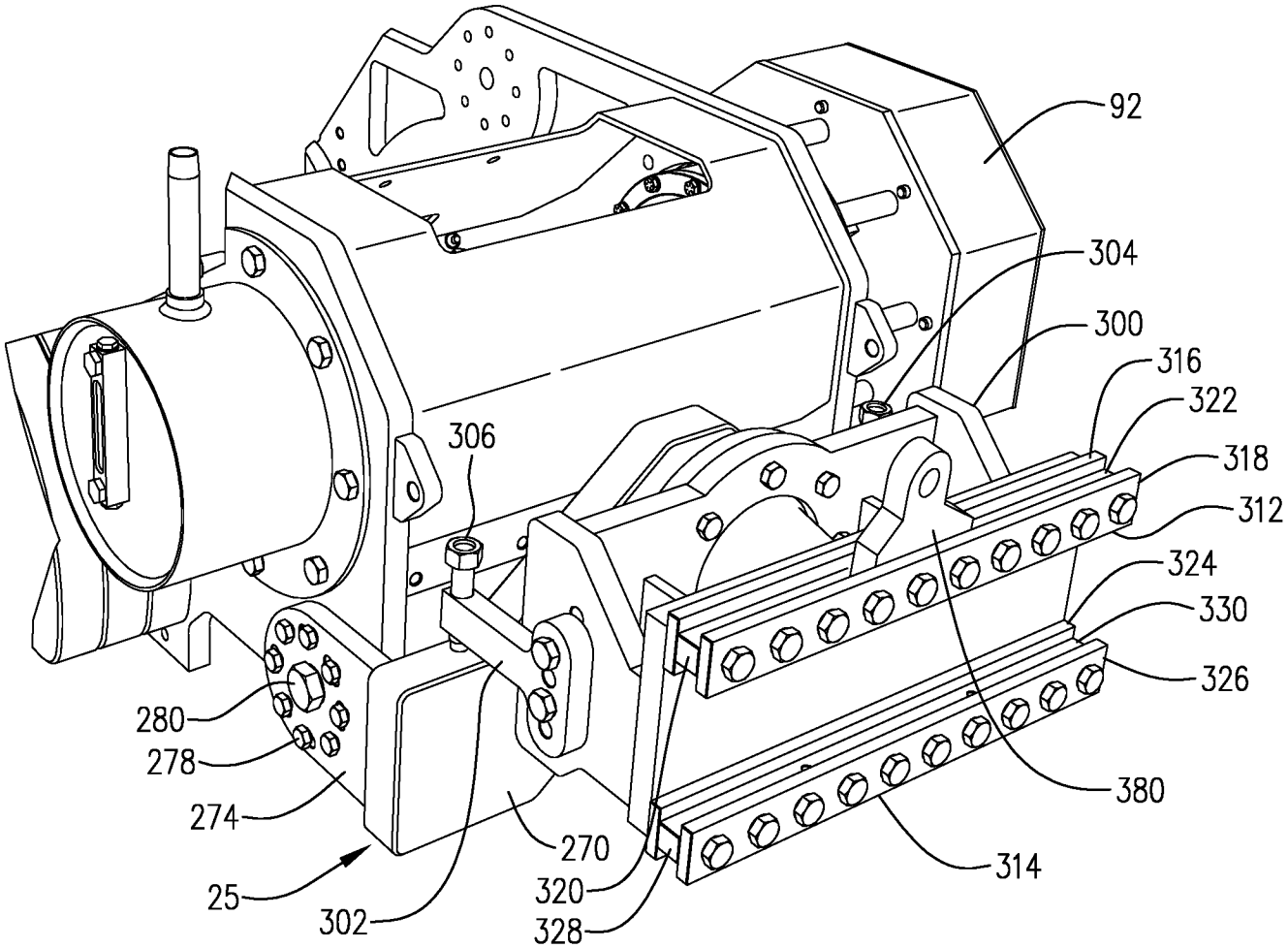
FIG. 13 is an isometric looking at the tool carrier connecting frame at the rear portion of the tool carrier.
Figure 14:
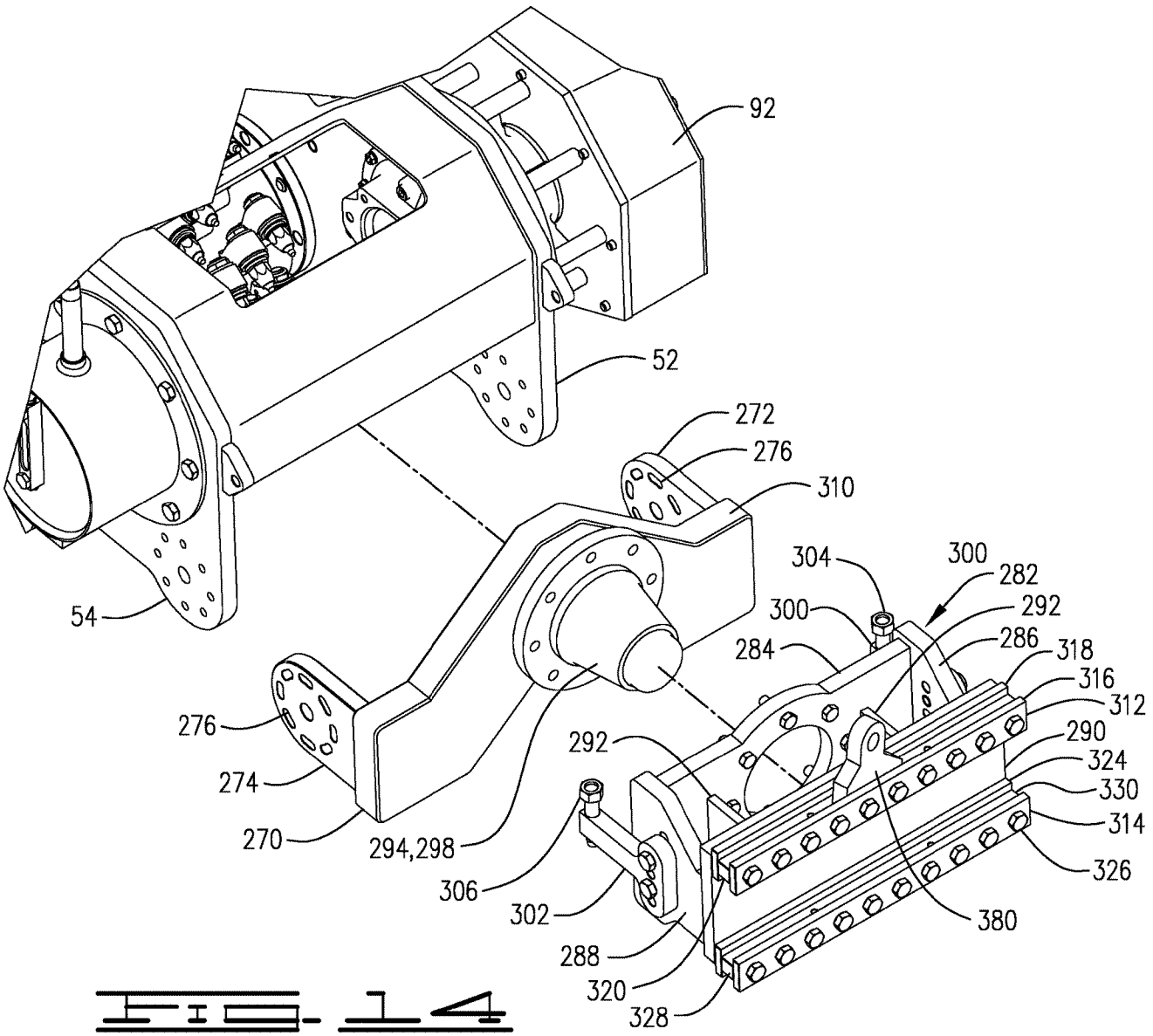
FIG. 14 is an exploded view showing features of certain details of FIG. 13.
Figure 15:
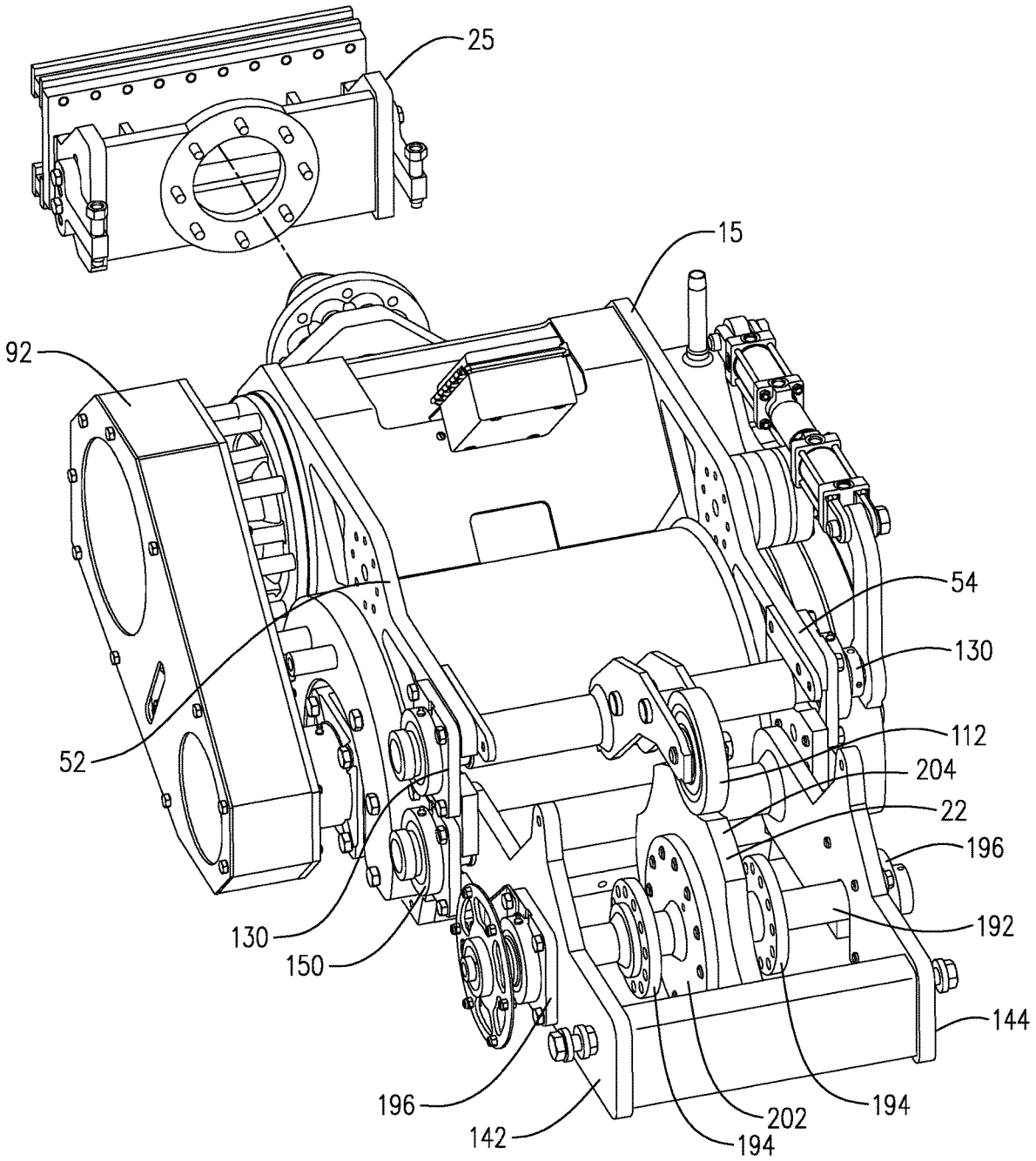
FIG. 15 is an isometric showing the apparatus with the tool carrier connecting frame separated from the tool carrier and without the wheels.
Figure 15:
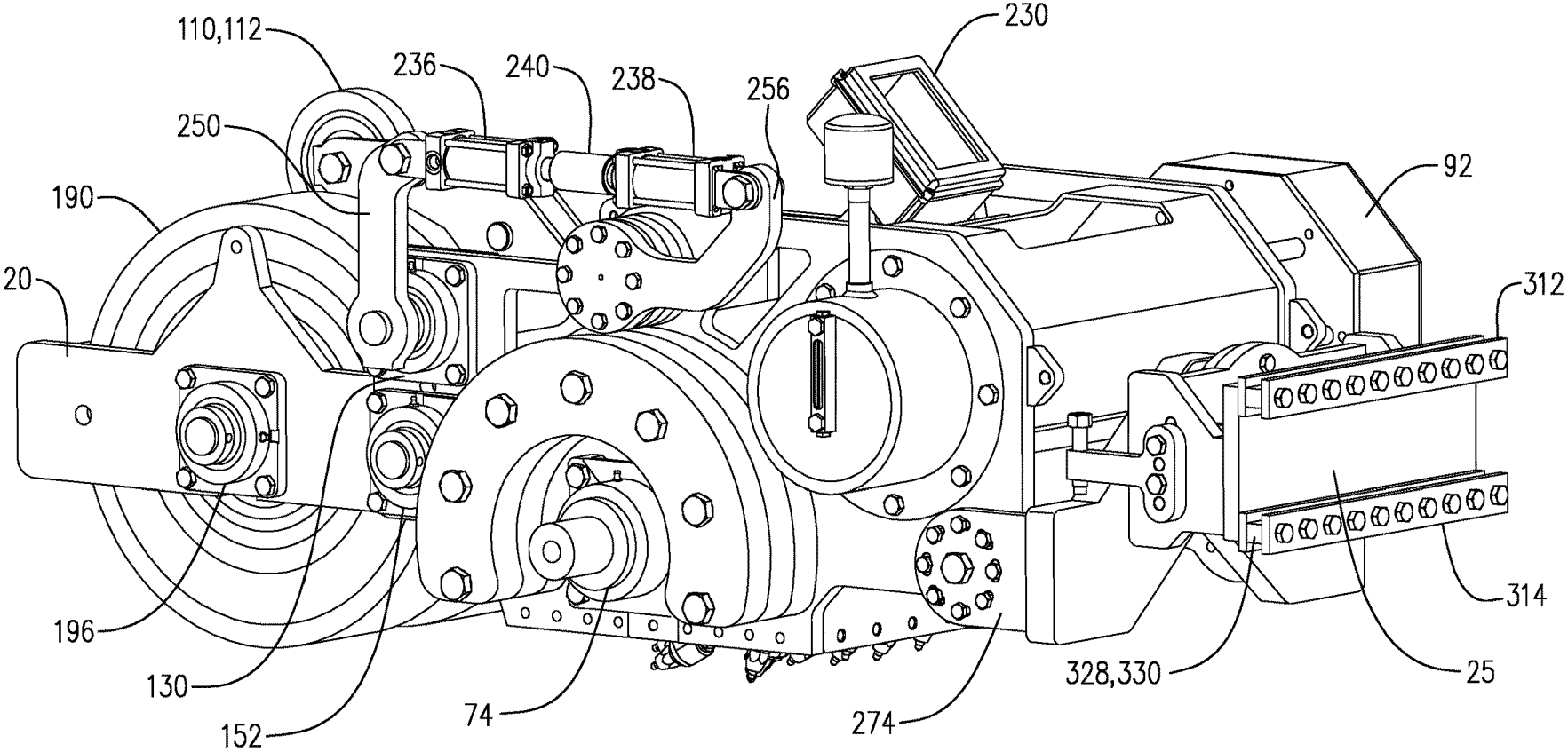
Figure 17:
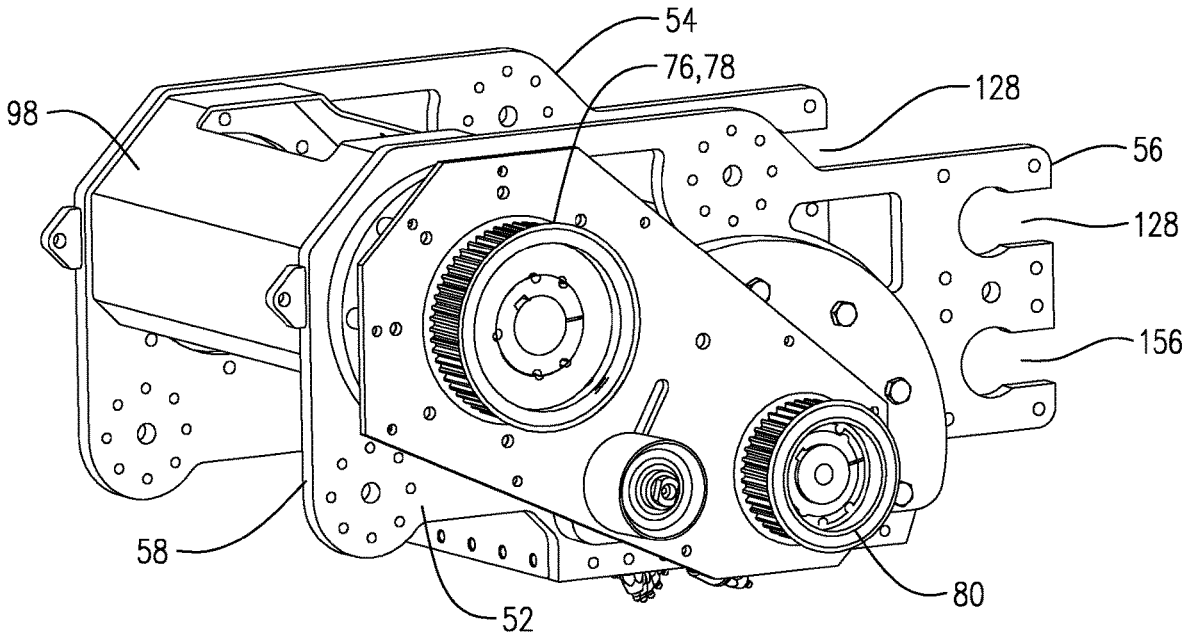
Figure 18:
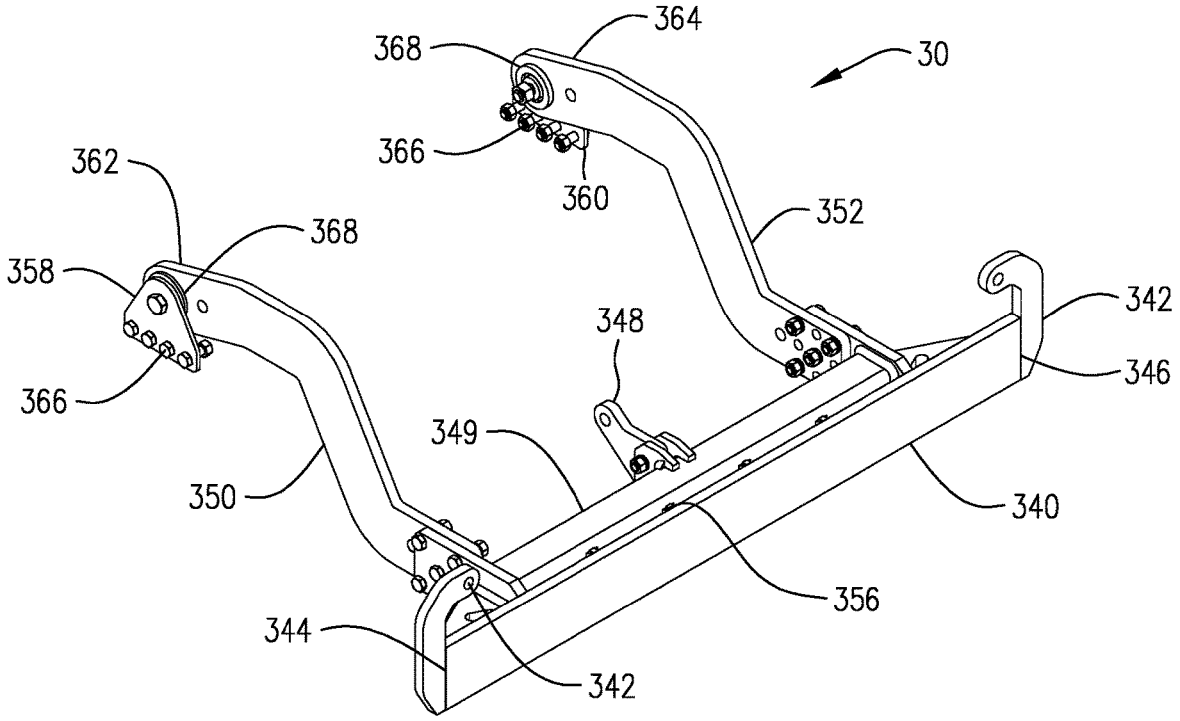
FIG. 18 is a section view of the apparatus without the tool bar connecting frame or the vehicle.
Figure 17:
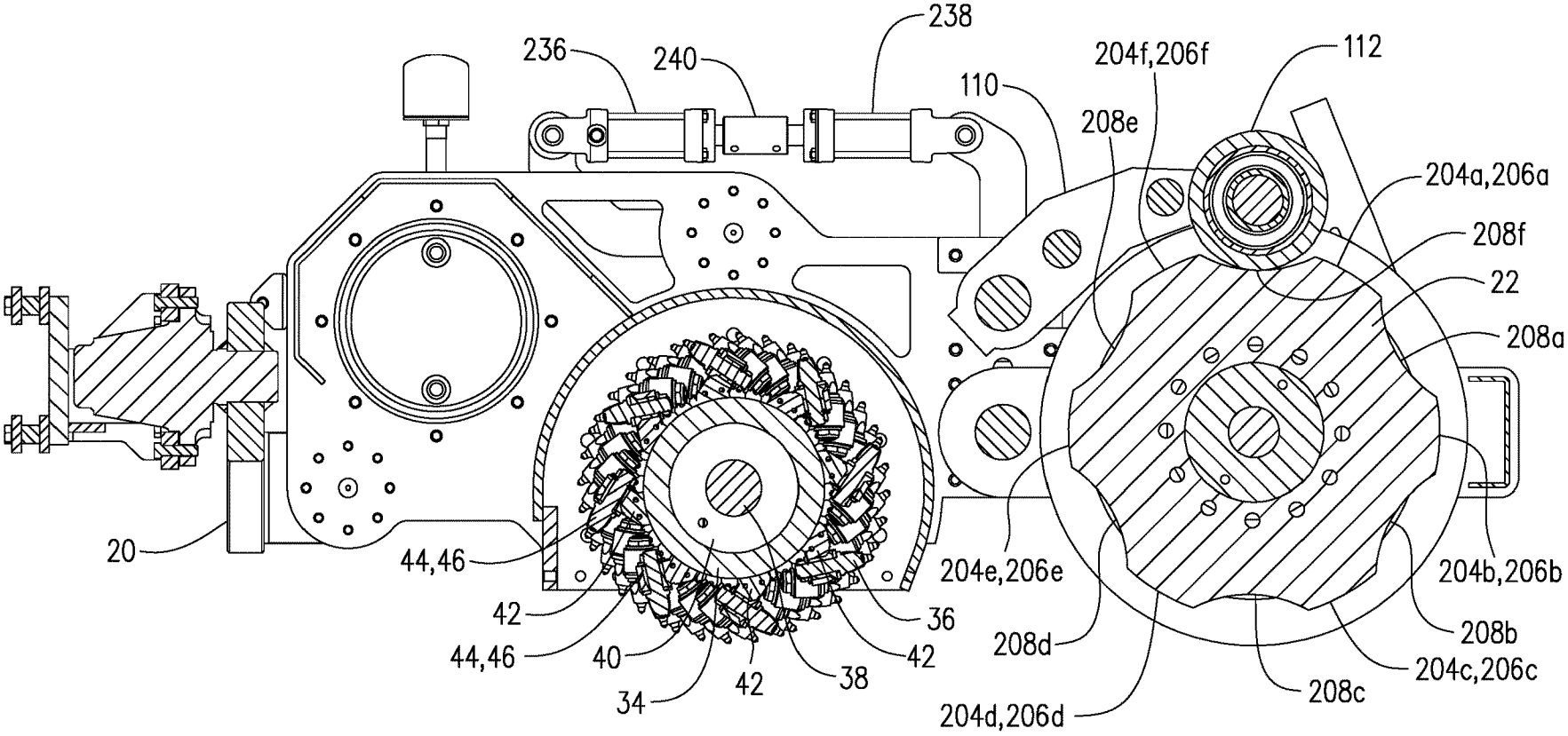

Tool carrier 15 comprises a pair of side plates 50 which may comprise right and left side plates 52 and 54. Details of side plates 52 and 54 are easily seen in FIGS. 10 and 11. Side plates 50 each have a forward end 56 and a rear end 58. A tool cover, or drum cover 60, is welded at both sides 62 and 64 thereof to the inner surface 66 of both of side plates 54 and 52. Side plates 52 and 54 each have an opening 70 defined therein through which tool shaft 38 extends. A bearing 72 which may be a roller bearing or other bearing known in the art is connected to side plate 54. Tool shaft 38 will rotate therein. A bearing 74, which may be identical to bearing 72, is attached to side plate 52 to likewise provide for rotation of shaft 38. Shaft extends through openings 70. The shaft may be rotated by means known in the art. The embodiment described utilizes a carbon fiber belt and pulley system 76.

Belt and pulley system 76 includes a drive pulley 78 and a follower pulley 80 around which a belt is placed. The belt is not shown in the drawings but it is understood that a belt of a type known in the art, such as a carbon fiber belt may be used. Shaft 38 will be keyed or otherwise connected to follower pulley 80. A hydraulic motor 84 mounted to tool carrier 15 is driven by the hydraulics from vehicle 10, or from other hydraulic source in a known manner. A reducing gear, for example a planetary reducer 86 will reduce the speed of rotation to a desired rotational speed for drive pulley 78. A shaft 88 will rotate drive pulley 78 at the desired speed. The belt will rotate pulley 80, and thus shaft 38 at a desired speed. The hydraulic motor 84 and planetary reducer 86 may be selected to achieve the desired rotational speed of the grinding tool 32. A cover 92 can be used to cover the belted pulley system 76.

A plurality of weights 94 are connected to side plate 54 with bolts or other means. A weight 96 is likewise connected to side plate 52. Weights 94 and 96 help to provide sufficient weight so that enough downward force is applied to cut grooves into ground surface. In addition oil, or other fluid, and small metal pieces, such as steel shot can be used to fill the space between shaft 38 and grinding drum 34 for additional weight. A motor cover 98 with opening 100 therein may be welded to plates 52 and 54 to protect motor 84.

Cam 22 is positioned forward of grinding tool 32. A cam roller assembly 110 includes a cam roller 112 that engages cam 22. A cam roller arm 114 which comprises a pair of spaced apart arm plates 116 is connected at one end to cam roller 112 and at a second end to a cam roller shaft 118. Cam roller shaft 118 comprises a stepped shaft with first and second diameters 120 and 122 on center portion and outer portions 124 and 126, respectively. Outer portions 126 pass through openings 128 in plates 52 and 54, and are rotatably supported by bearings 130 which are connected to plates 52 and 54.

Wheel mounting assembly 20 has a pair of wheel assembly side plates 140 which may be identified as right and left wheel assembly side plates 142 and 144. A forward connecting beam 146 may be welded or otherwise connected to wheel assembly side plates 142 and 144. Wheel mounting assembly 20 is pivotally connected to tool carrier 15. Wheel mounting assembly 20 and tool carrier 15 pivot relative to one another when apparatus 5 is operating to cut grooves into a ground surface. Tool carrier 15 and wheel mounting assembly 20 likewise will pivot relative to each other when apparatus 5 moves between grinding and skip positions as detailed below.

Bearings 150 and 152 attached to side plates 52 and 54 rotatably support a wheel mounting assembly shaft 154. Wheel mounting assembly shaft 154 extends through openings 156 and 158 in side plates 52 and 54 of tool carrier 15. Wheel mounting assembly shaft 154 may be a stepped shaft with first outer diameter 162 on end portions 164 thereof and second outer diameter 166 on a center portion 168 thereof. Outer diameter 166 is greater in magnitude than outer diameter 162. Outer portions 164 will extend through and be rotatably supported by bearings 150 and 152. Shaft 154 is welded or otherwise fixed to wheel assembly side plates 142 and 144 on the inner surface thereof by welding or other means known in the art. Wheel assembly 20 will therefore pivot relative to tool carrier 15.

Straps 172 and 174 may be connected to side plates 52 and 54 and have openings 176 defined therein. Wheel mounting assembly side plates 142 and 144 may have raised portions 178 and 180 respectively, each with an opening 182 therein. Chains 184 are connected at openings 176 and 182 to the straps 172 and 174 and raised portion 180. The chains will prevent wheel mounting assembly 20 from engaging the ground surface when tool carrier 15 is raised to a travel position to allow travel over a road or other ground surface from one site to another to have grooves cut therein.

Wheels 190 are mounted to a wheel axle 192. Wheels 190 have outside edges 191 and 193 and are mounted to wheel axle 192 with wheel plates 194 which are bolted or otherwise connected to wheels 190. Wheel plates 194 are welded to or otherwise connected to wheel axle 192 and as a result will rotate therewith. Bearings 196 rotatably support wheel axle 192. Wheel axle 192 extends through openings 198 and 200 in the wheel assembly side plates 142 and 144. Bearings 196 are connected to right and left wheel assembly side plates 142 and 144. Cam 22 may have an opening such that it can be moved into position at a center of wheel axle 192. Thus, an opening in cam 22 may be of a size such that it will slide over wheel plates 194. Cam 22 is connected to cam plate 202 which is fixed by welding or otherwise to wheel axle 192. Wheel axle 192 may also be referred to as a cam shaft 192. Cam 22 has a plurality of lobes 204 defining high spots 206. Cam 22 likewise defines low spots 208. In the current embodiment, cam 22 has six lobes 204*a* through 204*f* respectively. It is understood however that the cam can have a desired number of lobes and be designed such that grooves are cut at the proper spacing and timing. Lobes 204*a* through 204*f* have high spots 206*a* through 206*f* respectively. Cam 22 has low spots 208*a*-208*f*.

When apparatus 5 is moved along a ground surface, cam roller 112 will follow the shape of cam 22. Cam roller 112 will move up and down along the contour of cam 22 and will raise and lower tool carrier 15 and as a result grinding tool 32. Apparatus 5 has skip and grinding positions. In the grinding position, the rotation of cam 22 will cause grinding tool 32 to move in and out of engagement with the ground surface in which grooves or depressions are to be cut. In the skip position tool carrier 15 is raised such that the grinding tool 32 will not engage the surface. However, in the skip position, cam roller 112 will still move up and down along the contour of the cam 22 since the cam 22 will rotate as the wheels 190 engage and move along the ground surface. An adjustable guide bar 214 with an outer tube 215 and inner tube 216 slidable therein is attached to a forward end of guide bar connectors 210. Guide bar connectors 210 are connected with bolts or other connectors to wheel assembly side plates 142 and 144. Outer tube 215 has lock pin holes 217 therein, which may align with holes 218 in inner tube 216. A guide wheel 219 is mounted to an end of tube 216. Guide wheel 219 is positioned so that the ends of grooves are properly spaced from, for example a roadway edge. For example, if the end of a groove is to be spaced 12 inches from a roadway edge, guide wheel 219 will ride along that edge, and will be spaced 12 inches from one of the edges 48 or 49 of the grinding drum 34. As is apparent the wheel can be placed on either side of apparatus 5, to provide the proper spacing when grooves are cut in shoulders on the right and left shoulders of a roadway.

Figure 24:
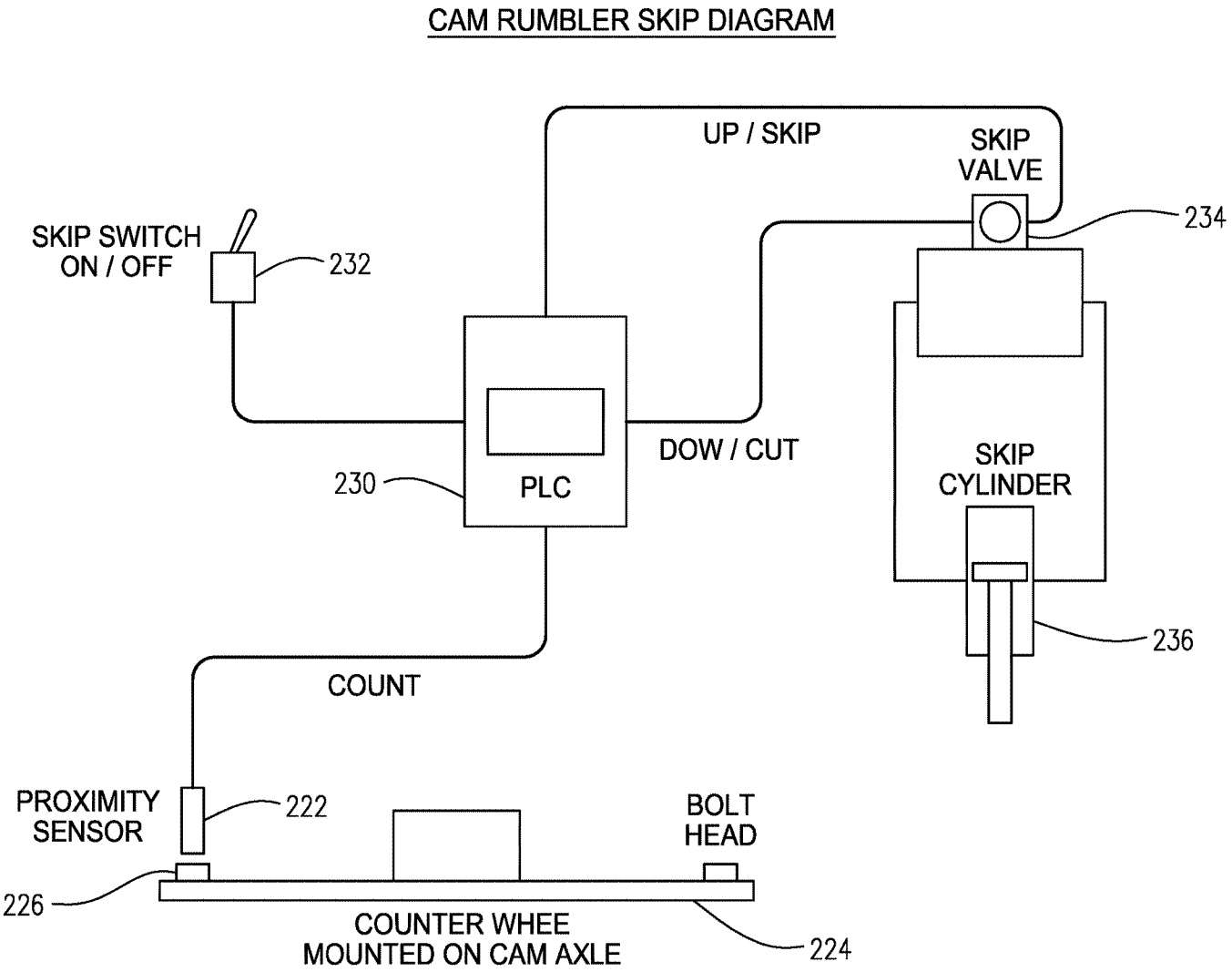
FIG. 24 is a schematic of the skip control system.
Figure 25:
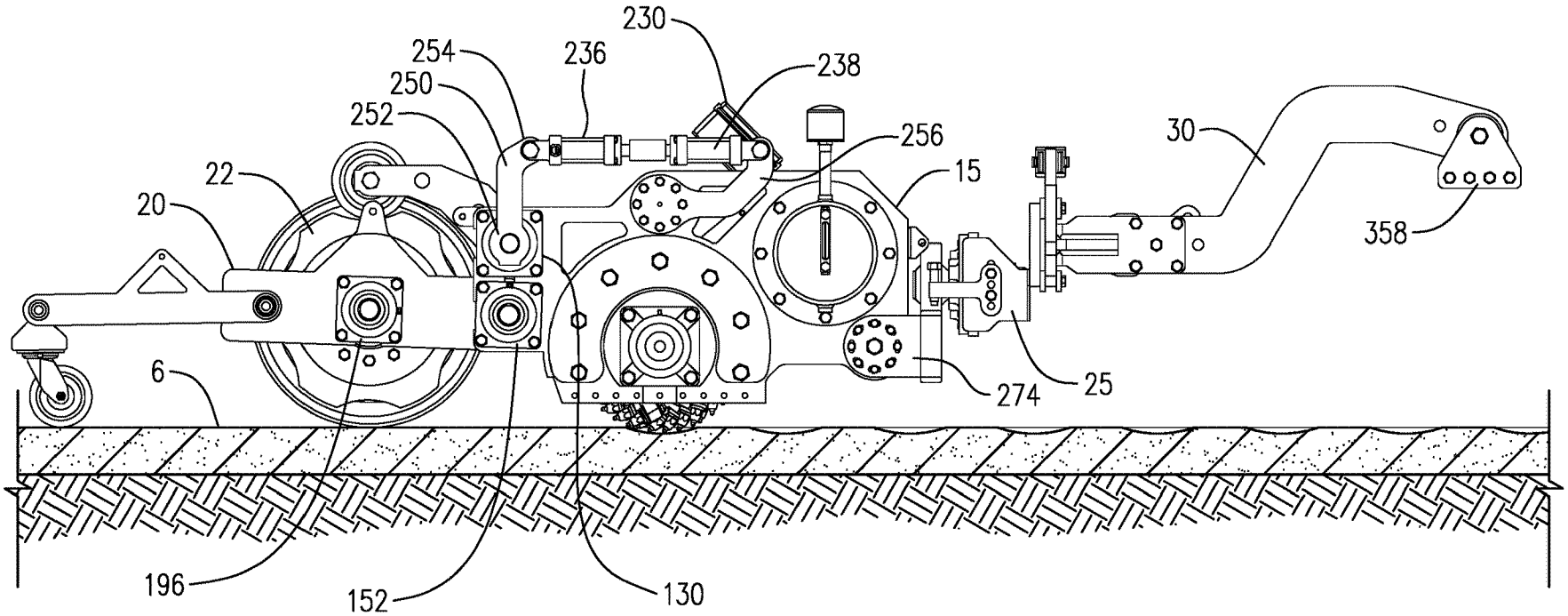
FIG. 25 shows the apparatus in the grinding position with the grinding tool engaging a ground surface.
Figure 25:
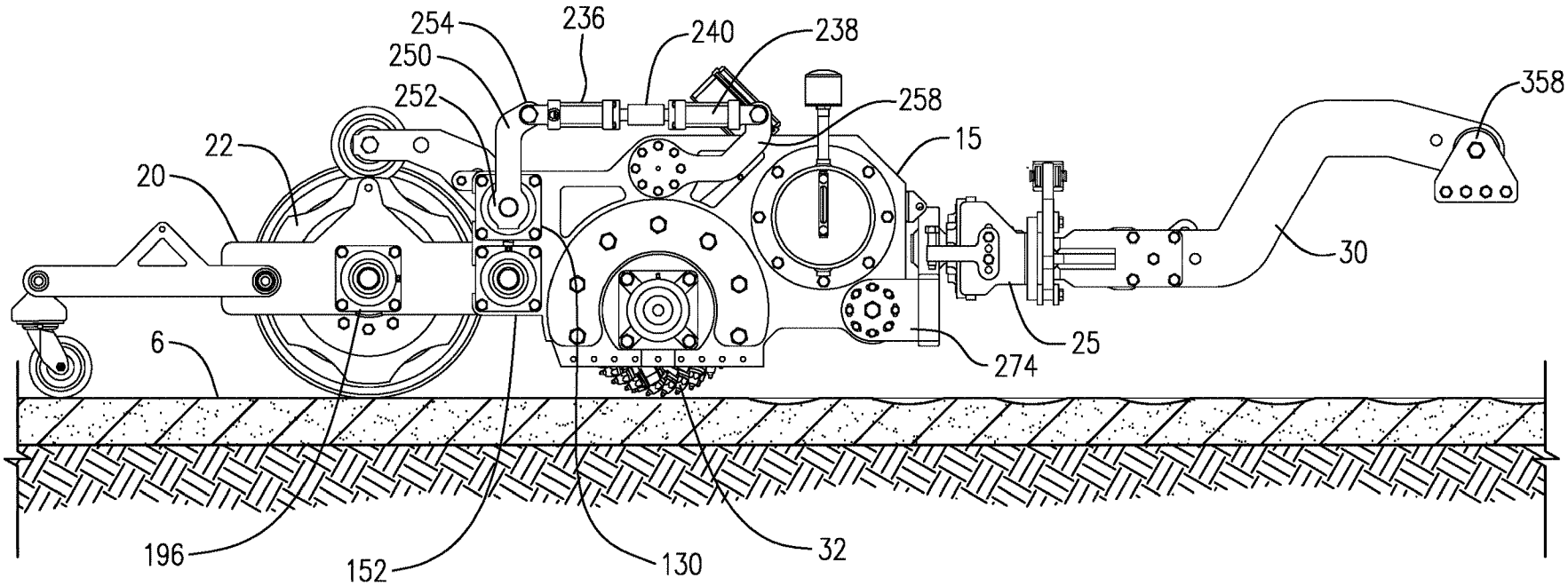

A sensor bracket 220 is connected to bearing 196 that is attached to wheel assembly side plate 142. A sensor 222, which may be a proximity or other type of known sensor, is connected to sensor bracket 220. A counting wheel 224 with a plurality of distance indicators 226 which may be bolts or other known articles are connected to counting wheel 224 at spaced intervals. Proximity sensor 222 is electrically connected or otherwise connected to provide signals to a programmable logic controller (PLC) 230. As will be explained in further detail, the apparatus 5 includes a skip on and off switch 232 (FIG. 24). When skip switch 232 is in the off position, apparatus 5 will cut grooves in a roadway in a continuous manner at the desired spacing. In other words, rather than cut groups of grooves with a space between the groups of grooves, apparatus 5 will simply cut grooves at the desired spacing. For example, in the embodiment shown, apparatus 5 has wheels 190 that may be a 72 inch diameter. Cam 22 has six lobes 204 with high points 206 and has low points 208, such that, in the embodiment shown, at low points 208 grinding tool 32 will be lowered to engage a ground surface, such as a shoulder of a roadway and cut grooves into the surface at one foot intervals. Sensor 222 would provide a count to the PLC 230 indicating how many grooves have been cut at the one foot intervals. When skip switch 232 is in the on position, apparatus 5 is in skip mode, and the tool carrier 15 and thus the grinder tool 32 is moveable from the grinding position in which grooves are cut to a skip position.

For example, if it is desired to cut a series of six grooves and then skip a twelve foot space before then cutting a second group of six grooves, apparatus 5 will automatically move between the grinding and skip position. When the skip switch is on, once sensor 222 sends signals to the PLC 230 that the desired number of grooves has been cut and a skip is desired, a skip valve 234 will allow hydraulic fluid to move into an inlet on a skip cylinder 236. The skip cylinder 236 will then move which will cause the tool carrier 15 to lift such that grinding tool 32 cannot engage the surface during the skip cycle. Once the predetermined skip distance has passed as determined by the PLC 230, skip valve 234 will allow hydraulic fluid to move skip cylinder 236, and grinding tool 32 to the grinding position. As shown in the figures, apparatus 5 includes both skip cylinder 236 and a depth control cylinder 238. Skip cylinder 236 is connected by hydraulic lines to the hydraulic system on vehicle 10. Likewise, depth control 238 cylinder is hydraulically connected to the hydraulics on vehicle 10. Skip cylinder 236 has a piston rod 240 extending therefrom, and depth control cylinder 238 has piston rod 242 extending therefrom. A connector 244 connects piston rods 240 and 242.

A connecting arm 250 is connected at one end 252 thereof to cam roller shaft 118. The second end 254 is connected to hydraulic cylinder 236 such that upon movement of the piston rod 240, end 254 will move. A second connecting arm 256 has one end 258 connected to depth control cylinder 238. The second end 260 of second connecting arm 256 is connected to one of a plurality of spacers 262 utilized to space second connecting arm 256 from side plate 54.

Depth control cylinder 238 will controlled by a control switch in vehicle 10 which will extend or retract piston rod 242 from depth control cylinder 238. When apparatus 5 initially begins operation, depth control cylinder 238 will be set such that the depth of the grooves in the ground surface will be at a desired depth. In many cases this may be, for example, a ½ inch to ⅝ of an inch. After extensive use bits 36 may become ground down such that an adjustment much be made. In order to adjust the depth, piston rod 242 will be retracted slightly which will cause a clockwise rotation of cam roller axle 118. The slight clockwise rotation will cause the tool carrier 15 and thus grinding tool 32 to be lowered slightly so that the proper depth of groove can once again be achieved.

Figure 27:
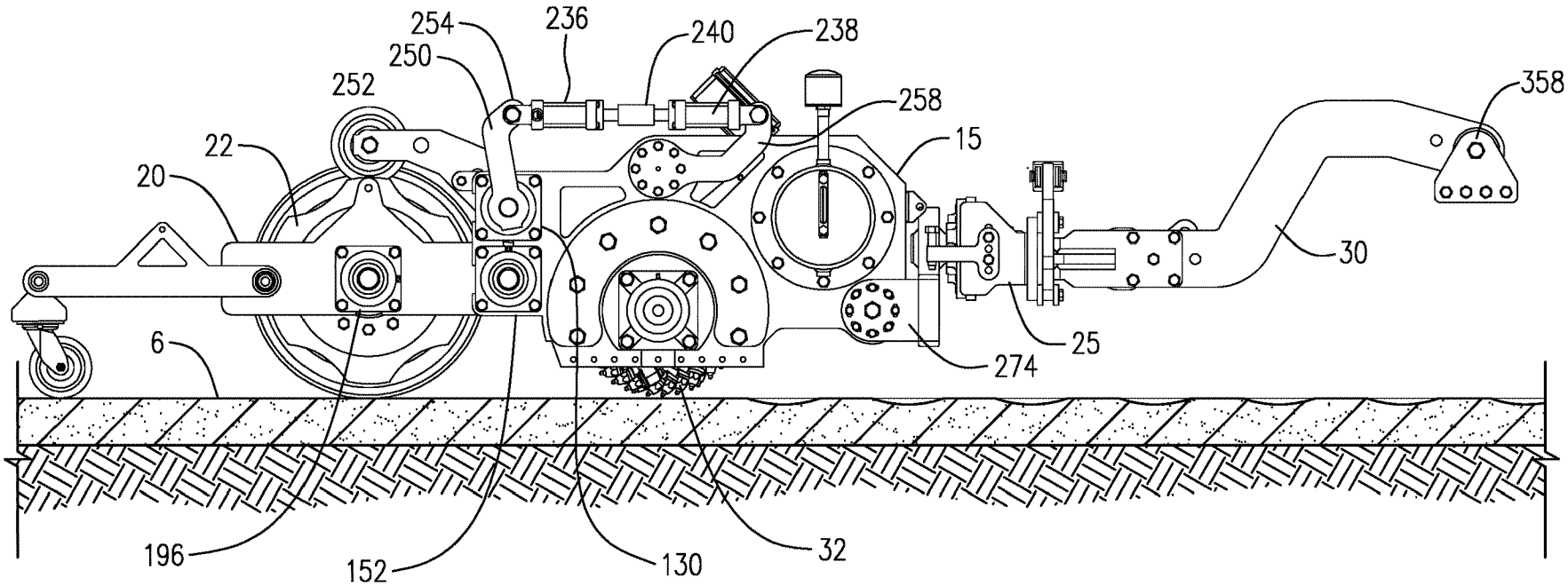
FIG. 27 shows the skip cylinder extended and the grinding tool in the skip position.

With respect to the skip control, when the skip switch 232 is on piston rod 240 will be extended as depicted in FIG. 27 which will move arm 250 to rotate shaft 118 counterclockwise when a skip is desired. The counterclockwise rotation will lift tool carrier 15 and thus grinding tool 32 such that even though wheels 190 are still engaged with the road surface and the cam roller 112 is moving up and down, grinding tool 32 will be spaced from the ground surface such that no grooves will be cut into the ground surface. Once the predetermined skip distance has been reached, valve 234 will move to a position such that hydraulic fluid will cause piston rod 240 to retract and cause clockwise rotation of cam roller shaft 118 through the movement of arm 250. Tool carrier 15 and grinding tool 32 will thus move back into the grinding position. This operation can occur as many times as desired during a grinding session. The wheel mounting assembly 20 is pivotable relative to tool carrier 15 so that as the apparatus 5 moves between the grinding and skip positions wheels 190 will stay in full contact with the ground surface.

Tool carrier connecting frame 25 connects tool carrier 15 to vehicle 10. Tool carrier connecting frame 25 is connected to tool bar frame 30, which is connected in turn to vehicle 10. The tool bar frame 30 is pivotably connected to vehicle 5 such that it will rotate about axis 12 which is perpendicular to the direction of travel of the vehicle. Tool carrier frame 25 comprises a connecting beam 270 with arms 272 and 274 connected to and extending therefrom at the ends thereof. Connecting arms 272 and 274 are connected to side plates 52 and 54 of tool carrier 15 with bolts 278. Arms 272 and 274 have bolt receiving slots 276 defined therein. Bolts 278 along with a center bolt 280 will connect connecting beam 270 to tool carrier 15. Slots 276 provide for adjustment of tool carrier 15 prior to connection to ensure that the tool carrier 15 is in a level or desired position relative to vehicle 10 and the ground surface.

A connecting framework 282 has a forward plate 284, opposed side plates 286 and 288 and a rear plate 290 connected by welding or other means known in the art. A pair of intermediate support beams 292 may likewise extend between and be connected to forward plate and rear plate 284 and 290 respectively. A tapered roller bearing 294 with a bearing shaft 296 connects connecting beam 270 to framework 282 at forward plate 284. Bearing shaft 296 will rotate relative to a bearing housing 298. As a result, tool connecting beam 270 will rotate relative to framework 282 and thus relative to vehicle 10. Because connecting beam 270 is rigidly fixed to tool carrier 15, tool carrier 15 and grinding tool 32 connected thereto will likewise rotate about axis 14 that is parallel to the travel of the vehicle.

A pair of leveling arms 300 and 302 may be connected to opposed side plates 286 and 288. Leveling pins 304 and 306 may be threaded into openings at the ends of leveling bars 300 and 302 and will engage a top surface 310 of connecting beam 270. Leveling pins 304 and 306 prevent the tool carrier 15 from tipping or flipping side to side when the apparatus 5 is in the travel position.

Upper and lower slides 312 and 314 are mounted to rear plate 290. Upper slide comprises opposed slide plates 316 and 318 with a spacer bar 320 therebetween defining a space 322. Lower slide 314 comprises a pair of opposed side plates 324 and 326 with a spacer bar 328 therebetween defining a space 330. Spaces 322 and 330 are preferably identical. Tool bar frame 30 and more specifically a toolbar 340 is received in slides 312 and 314 and is clamped therein. A hydraulic cylinder or other actuator will push and/or pull tool carrier frame 25 laterally along tool bar 340, so that grooves can be cut offset from the left and/or right of the center of the vehicle. In other words, the middle point of a groove can be aligned with the vehicle center, or the middle of a groove can be offset from the vehicle center.

Tool bar frame 30 includes tool bar 340 with lateral actuator connections 342 at the ends 344 and 346 thereof (FIG. 19). A lifting lug 348 is connected to a longitudinal connecting center beam 349 that extends between right and left connecting arms 350 and 352. Right and left connecting arms 350 and 352 are rigidly fixed to tool bar 340 directly or indirectly through connectors, welds, bolts or other means. A plurality of cross beams 356 may be utilized to connect center beam 349 to tool bar 340 and to provide strength. Connecting plates 358 and 360 are positioned at ends 362 and 364 of arms 350 and 352. Plates 358 and 360 are bolted or otherwise connected to the vehicle frame with bolts 366. Arms 350 and 352 are rotatably supported by bearings 368. As a result, tool frame 30 will rotate about bearings 368 such that the tool carrier 15 and grinding tool 32 are pivotable about axis 12 through bearings 368 and therefore is pivotable about an axis perpendicular to the direction of travel of vehicle 10.

A lifting cylinder 370 is mounted to vehicle 10 and to lifting lug 348. The lifting cylinder 370 can be actuated to raise the tool carrier 15 and wheel mounting assembly 20, by lifting tool bar connecting frame 30. A lateral actuator 372 which may comprise hydraulic cylinder 372 may be connected to either of lateral actuator connectors 342. Lateral actuator 372 has first and second ends 374 and 376. Second end 376 will be connected to a lug 380 that is fixed to tool carrier frame 25. Lug 380 may be mounted to upper slide 312. Actuation of hydraulic cylinder 372 to extend the piston rod therein will cause the tool carrier 20 and thus tool carrier 15 to move laterally relative to the vehicle 10. As a result, the tool carrier 15, and thus grinding tool 32 can be moved laterally. In this way, grooves can be cut off center from vehicle 10. This allows for the cutting of grooves, for example, on roadways where a shoulder is small and vehicle 10 can not be driven completely on the shoulder. In the current embodiment the outside edges 191 and 193 of wheels 190 are aligned with grinding drum edges 48 and 49 when the grinding tool 32 is at the center of vehicle 10. Tool carrier 15 can be moved laterally such that an edge of grinding tool 32 is equal to or outside the vehicle tire. Thus, grooves can be cut off center to the left or right of the center of the vehicle 10. The lateral movement can be such that grinding tool 32 can be moved so that the outer edge of the drum is aligned with the outer edge of the front wheels on vehicle 10, or outside such edge.

Figure 21:
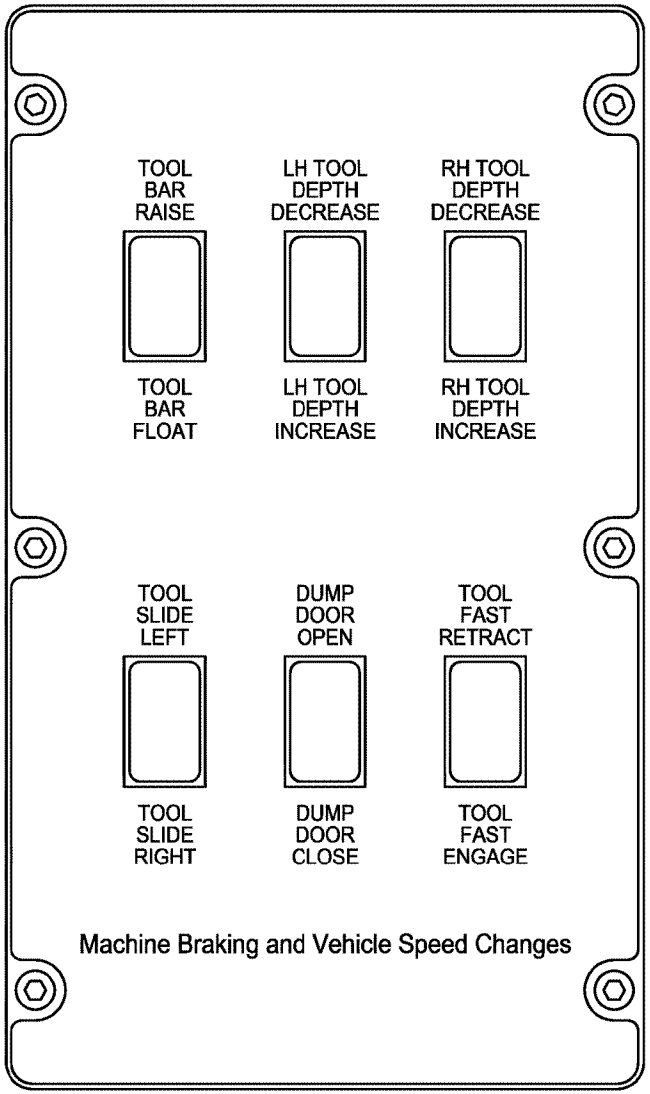
FIGS. 20 and 21 show representative control panels.
Figure 20:
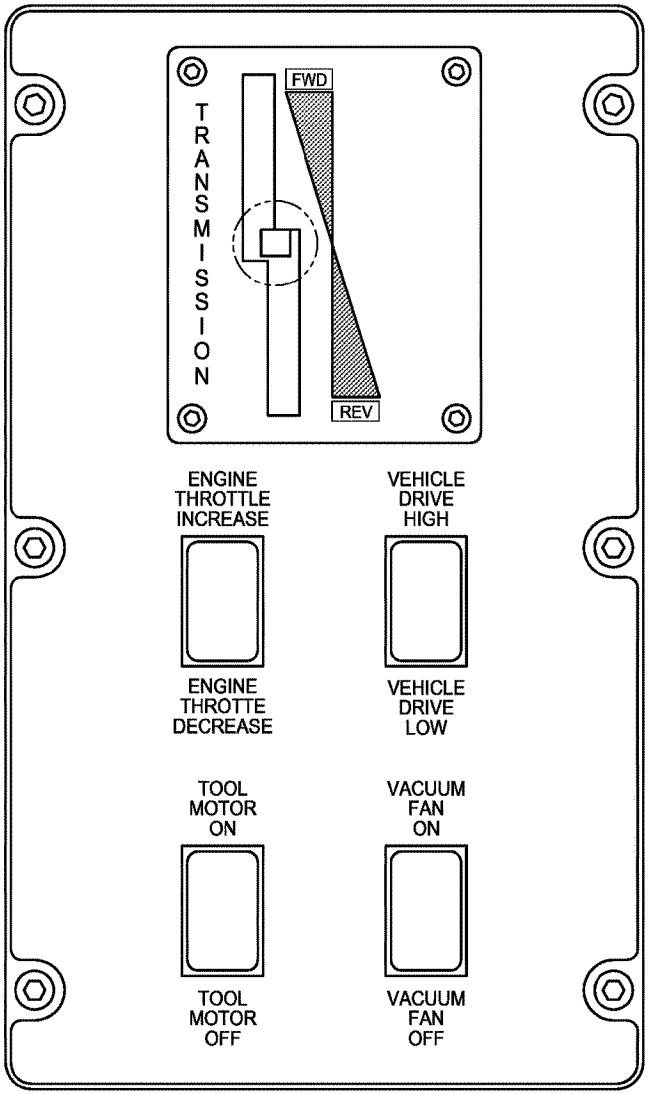
Figure 22:
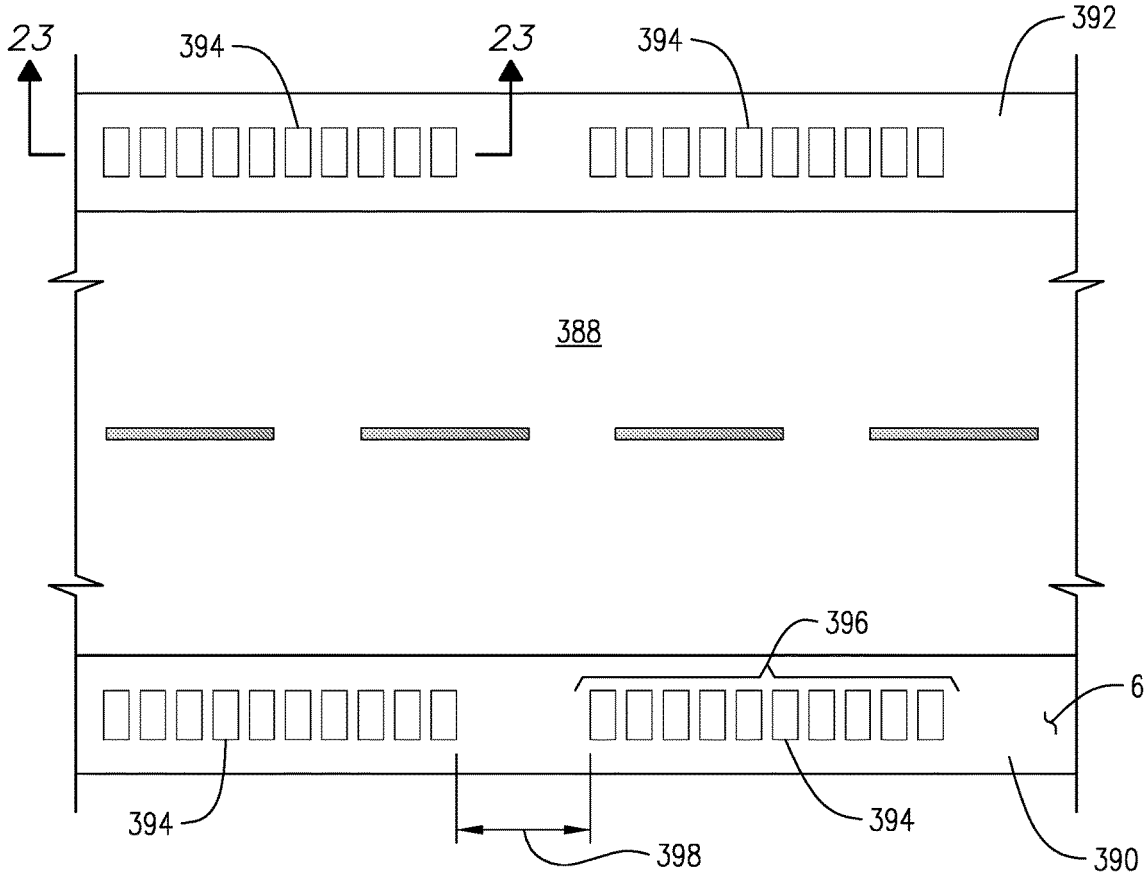
FIG. 22 schematically shows a roadway with a shoulder.
Figure 23:
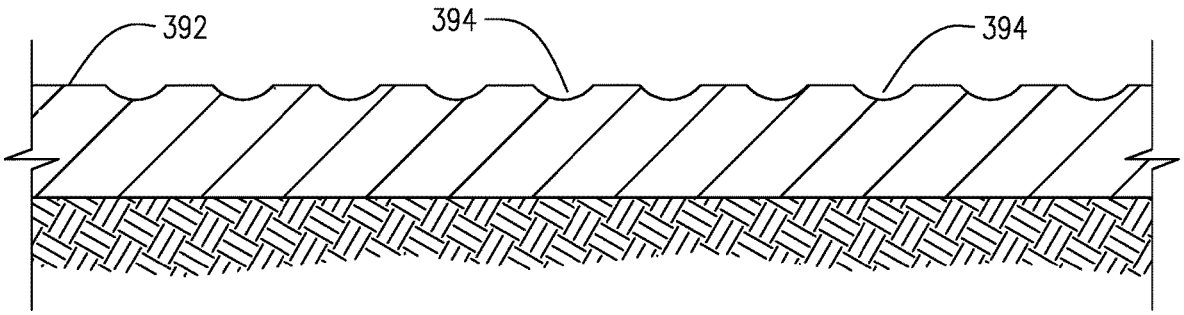
FIG. 23 is a section of a shoulder with grooves therein.

FIGS. 20 and 21 depict control panels that may be utilized in the vehicle. FIG. 22 is an example of a roadway with grooves cut therein. FIG. 20 shows a panel that may be used in vehicle 5 and includes switches or controls that will not be utilized for all tools. In this case, the tool bar raise and tool bar float switch controls the vertical position of tool carrier 15 with the lift cylinder 370. If the tool bar raise is actuated hydraulic cylinder 370 will lift tool carrier 15 and wheel carrier 20 above the ground to a travel position. In travel mode, grinding tool 32 is not being rotated since the travel mode is utilized to move vehicle 10 to a site at which grooves are to be cut. Once that site is reached the switch can be moved to a tool bar float. In this position tool carrier 15 will rotate or pivot about axis 12 perpendicular and axis 14 parallel to the direction of the vehicle travel. Only one of the left-hand tool or right-hand tool depth decrease and increase controls will be used. The switch is utilized when it is determined that due to wear on the grinding bits 36, depth control cylinder 138 should be slightly retracted to cause grinding tool 32 to move slightly downward in the grinding position to create grooves of the proper depth.

The tool slide left and tool slide right switch is utilized to actuate lateral actuator 372 to position tool carrier 15 in a desired lateral location relative to the center of the vehicle. Skip switch 232 will likewise be in the vehicle cab. The depiction in FIG. 22 is an exemplary schematic for a roadway 388 with shoulders 390 and 392. Apparatus 5 in skip mode will cut groups of grooves with a skip space therebetween as shown on shoulders 390 and 392. For example, shoulders 390 and 392 have grooves 394 cut in groups 396 of ten with a space 398 therebetween. Sensor 222 will send signals to PLC 230 so that after ten grooves 394 have been cut PLC 230 will signal valve 234 so that hydraulic pressure can be applied to urge piston rod 240 to an extended position and raise the tool carrier 15 to the skip position. Once the proper distance 398 between the groups 396 of grooves 394 has been reached, PLC 230 will send another signal to skip valve 232 which will then allow hydraulic pressure to be applied to the opposite end of cylinder 236 so that piston rod 240 will retract and the tool carrier 15 will move back into the grinding position so the next group 396 of grooves 394 can be cut. This process can be repeated as desired. Grooves 394 can be cut in the center of the roadway as well, and as explained can be cut in a continuous manner with no skip space.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. Apparatus for cutting grooves in a ground surface comprising:

a wheeled vehicle;

a tool carrier connected to the wheeled vehicle;

a grinding tool rotatably mounted to the tool carrier;

a forward frame pivotally connected to the tool carrier;

a wheel rotatable with a wheel axle supported by the forward frame and positioned in front of the grinding tool; and a rotatable cam, wherein rotation of the cam causes pivotal movement of the tool carrier relative to the forward frame, and wherein the cam rotates with the wheel axle.

2. The apparatus of claim 1 wherein the grinding tool is movable laterally relative to the wheeled vehicle.

3. The apparatus of claim 1 wherein the tool carrier is pivotally connected to the wheeled vehicle.

4. The apparatus of claim 1 wherein the forward frame is rotatable about the wheel axle.

5. The apparatus of claim 1, further comprising a cam roller connected to the tool carrier and configured to engage the cam, wherein rotation of the cam moves the grinding wheel up and down relative to the ground surface.

6. The apparatus of claim 5, further comprising an actuator configured to move the grinding tool between a skip and a grinding position, wherein in the skip position the grinding tool is spaced upwardly a sufficient distance from the ground surface such that the continued up and down movement of the grinding tool does not bring the grinding tool into engagement with the ground surface, and in the grinding position the grinding tool moves into and out of engagement with the ground surface to cut grooves therein.

7. The apparatus of claim 6, the actuator comprising a first hydraulic cylinder connected to the tool carrier, wherein extension and retraction of a piston rod extending from the hydraulic cylinder raises and lowers the grinding tool between the skip and grinding positions relative to a ground surface.

8. The apparatus of claim 7, wherein when the piston rod is in a fully extended position the grinding tool is in the skip position.

9. The apparatus of claim 7, wherein the grinding tool automatically moves between the grinding and skip positions.

10. Apparatus for cutting grooves in a ground surface comprising:

a wheeled vehicle;

a tool carrier pivotably connected to the wheeled vehicle;

a grinding tool mounted to the tool carrier configured to create grooves in the ground surface, the tool carrier being movable from a grinding to a skip position;

a wheel in front of the grinding tool; and a cam rotatable with the wheel, wherein the cam moves the grinding tool in and out of engagement with the ground surface when the tool carrier is in the grinding position.

11. The apparatus of claim 10, the tool carrier being rotatable about an axis parallel to the direction of travel of the vehicle and rotatable about an axis perpendicular to the direction of travel of the vehicle.

12. The apparatus of claim 10, wherein the grinding tool is movable laterally relative to the vehicle.

13. The apparatus of claim 10, further comprising a cam roller movable between first and second positions, wherein in the first position the tool carrier is in the grinding position and in the second position the tool carrier is in the skip position.

14. The apparatus of claim 13, further comprising a skip control cylinder movable between first and second positions, wherein the skip control cylinder moves the cam roller from the first to the second position to raise the tool carrier from the grinding to the skip position.

15. The apparatus of claim 14, wherein the second position is an extended position of the skip control cylinder, so that the cam roller raises the tool carrier to the skip position when the skip control cylinder is extended.

16. The apparatus of claim 10 further comprising;

a timing wheel operably associated with the cam; and a PLC, wherein a full rotation of the timing wheel corresponds to a full rotation of the cam, and wherein a sensor operably associated with the timing wheel sends a signal to the PLC reflecting a specified distance of travel of the apparatus based on the rotation of the timing wheel.

17. The apparatus of claim 16 wherein the PLC sends a signal to the skip control cylinder at specified distances to automatically move the grinding tool between the grinding and the skip positions.

18. Apparatus for creating grooves in a ground surface comprising:

a vehicle;

a tool carrier connected to the vehicle, the tool carrier being pivotable about an axis perpendicular to a direction of travel and about an axis parallel to the direction of the travel of the vehicle, wherein the tool carrier is movable laterally relative to the vehicle;

a grinding tool carried by the tool carrier configured to create grooves in the ground surface, the tool carrier being movable from a grinding to a skip position;

a rotatable cam, wherein the cam rotates when the apparatus moves along a ground surface and moves the grinding tool into and out of engagement with the ground surface when the tool carrier is in the grinding position; and a pair of wheels forward of the tool carrier, wherein the cam is positioned between and rotates with the two wheels.

19. The apparatus of claim 18 further comprising a cam roller engaged with the cam, the cam roller being connected to the tool carrier, wherein the rotation of the cam simultaneously raises and lifts the cam roller and tool carrier.

20. The apparatus of claim 19, the cam roller being movable between skip and grinding positions wherein in the skip position the tool carrier is raised so that the grinding tool is spaced from the ground surface and will not cut grooves therein.

21. The apparatus of claim 20 further comprising a skip control cylinder connected to the tool carrier, wherein the retraction and extension of the cylinder moves the cam roller to lower and raise the tool carrier between the grinding and skip positions.

22. The apparatus of claim 18, further comprising a lateral positioning actuator configured to move the tool carrier laterally relative to the vehicle.

23. The apparatus of claim 22, wherein the tool carrier is configured to cut grooves in the ground surface off set to the right and left of the vehicle center.

24. Apparatus for cutting grooves in a ground surface comprising:

a wheeled vehicle;

a tool carrier connected to the wheeled vehicle;

a grinding tool rotatably mounted to the tool carrier;

a forward frame pivotally connected to the tool carrier;

a wheel rotatable with a wheel axle supported by the forward frame and positioned in front of the grinding tool; and a rotatable cam, wherein rotation of the cam causes pivotal movement of the tool carrier relative to the forward frame, and wherein the forward frame is rotatable about the wheel axle.

25. The apparatus of claim 24, further comprising a cam roller connected to the tool carrier and configured to engage the cam, wherein rotation of the cam moves the grinding wheel up and down relative to the ground surface.

* * * * *